US010976026B2

(12) United States Patent
Dijken et al.

(10) Patent No.: US 10,976,026 B2
(45) Date of Patent: Apr. 13, 2021

(54) LIGHTING DEVICE WITH SPARKLING EFFECT

(71) Applicant: SIGNIFY HOLDING B.V., Eindhoven (NL)

(72) Inventors: Durandus Kornelius Dijken, Eindhoven (NL); Elise Claude Valentine Talgorn, Eindhoven (NL); Silvia Maria Booij, Eindhoven (NL); Johannes Maria Thijssen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/077,015

(22) PCT Filed: Mar. 2, 2017

(86) PCT No.: PCT/EP2017/054927
§ 371 (c)(1),
(2) Date: Aug. 9, 2018

(87) PCT Pub. No.: WO2017/153252
PCT Pub. Date: Sep. 14, 2017

(65) Prior Publication Data

US 2019/0032891 A1 Jan. 31, 2019

(30) Foreign Application Priority Data

Mar. 11, 2016 (EP) ..... 16159867

(51) Int. Cl.
*F21V 11/14* (2006.01)
*F21V 3/00* (2015.01)
(Continued)

(52) U.S. Cl.
CPC ..... *F21V 11/14* (2013.01); *F21V 3/00* (2013.01); *F21V 11/16* (2013.01);
(Continued)

(58) Field of Classification Search
None
See application file for complete search history.

(56) References Cited

U.S. PATENT DOCUMENTS 4,214,168 A 7/1980 Kulka
9,904,105 B2 * 2/2018 Ma ..... G02F 1/133606
(Continued)

FOREIGN PATENT DOCUMENTS

DE 102012104580 A1 12/2013
FR 1550163 A 12/1968
(Continued)

*Primary Examiner* — Diane I Lee
*Assistant Examiner* — Zachary J Snyder
(74) *Attorney, Agent, or Firm* — Daniel J. Piotrowski

(57) ABSTRACT

The invention provides a lighting device (12) configured to provide both functional lighting for illuminating a space, and simultaneously to present a spatially dynamic sparkling light display. The device comprises a chamber (14) containing one or more light sources (28). The light sources are arranged to direct light in the direction of a translucent surface portion (20), and in the direction of a plurality of light exit areas (32) delimited by the translucent surface portion. The light exit areas each have a higher transmittance than the surrounding surface portion.

13 Claims, 11 Drawing Sheets

(51) Int. Cl.

| | |
|---|---|
| ***F21V 11/16*** | (2006.01) |
| ***F21Y 115/10*** | (2016.01) |
| ***F21Y 107/60*** | (2016.01) |
| ***F21Y 113/13*** | (2016.01) |
| ***F21Y 107/90*** | (2016.01) |

(52) U.S. Cl.
CPC ..... *F21Y 2107/60* (2016.08); *F21Y 2107/90* (2016.08); *F21Y 2113/13* (2016.08); *F21Y 2115/10* (2016.08)

(56) References Cited

U.S. PATENT DOCUMENTS

2009/0003002 A1* 1/2009 Sato ..... G02B 6/0043 362/341
2009/0101930 A1 4/2009 Li
2010/0321919 A1 12/2010 Yang
2011/0018012 A1* 1/2011 Tanaka ..... F21V 13/02 257/89
2011/0044026 A1* 2/2011 Deeben ..... H01L 33/508 362/84
2011/0075410 A1 3/2011 Negley et al.
2013/0010232 A1 1/2013 Takahashi et al.
2013/0100696 A1* 4/2013 Brick ..... G02B 6/0058 362/603
2014/0160720 A1 6/2014 Seuntiens et al.
2015/0099415 A1* 4/2015 Harbers ..... H05B 33/0857 445/3
2015/0377425 A1 12/2015 Van Bommel et al.

FOREIGN PATENT DOCUMENTS

GB 2243223 A 10/1991
WO 2013140695 A1 9/2013
WO WO2014128601 A1 8/2014

* cited by examiner

LIGHTING DEVICE WITH SPARKLING EFFECT

CROSS-REFERENCE TO PRIOR APPLICATIONS

This application is the U.S. National Phase application under 35 U.S.C. § 371 of International Application No. PCT/EP2017/054927, filed on Mar. 2, 2017, which claims the benefit of European Patent Application No. 16159867.7, filed on Mar. 11, 2016. These applications are hereby incorporated by reference herein.

FIELD OF THE INVENTION

The invention relates to a lighting device for providing functional lighting to illuminate a space. The lighting device is simultaneously configured to provide a visually appealing lighting effect, in particular, a dynamic sparkling or glittering effect. The lighting device can for example be used in a lighting display or installation.

BACKGROUND OF THE INVENTION

The natural world provides many examples of so called dynamic lighting effects, and these phenomena can, for the observer, be highly captivating and entrancing aesthetic experiences. Consider, for example, sunlight refracted by water droplets or reflected on the moving sea surface, erratic star light, or sunlight blocked sporadically by the moving leaves of a tree. One particularly striking and notable effect is that of sunlight reflecting from snow.

Lighting designers often seek to recreate this striking effect of dynamic lighting in time and space. Dynamic lighting in time is easily realized through individually addressing LEDs within an LED ensemble. Dynamic lighting in space—a variation in light intensity depending on the viewer position—is often achieved through the use of glittering particles, lead glass crystals, or, in more complex solutions, through mechanisms that spatially displace the LED or optics. The effect created by dynamic lighting in space is commonly called glittering, or sparkling.

Glittering as a decorative effect is frequently used in architecture and in interior design, to provide a high end finish to walls or ceilings. It is visually appealing, and can provide a sense of luxury or glamour. Most standardly, glittering is achieved by reflecting light onto specularly reflective particles or by transmitting light through lead glass crystals.

This is usually achieved through applying glittering particles or lead glass crystals onto a surface, and using the reflection of light which is emitted by light sources installed at a distance from the surface. In this case, however, the light source must be installed as a separate component, which is aesthetically invasive and more burdensome and complex to install.

An alternative solution is to install the lead glass crystals into a panel, and to mount the light source(s) directly onto the back of them. Here, the light source remains hidden and the whole apparatus can be provided in a single, unitary panel.

However, use of lead glass crystals to achieve sparkling is not ideal. The crystals are generally expensive and heavy, and mounting them into a panel in order to realize the solution described is far from trivial.

In GB2243223A is described an illumination device designed to simulate the night sky. The device comprises a lighting panel having a front plate comprising holes, and which contains a plurality of conventional light sources, arranged to direct light toward said front plate. Between each of the light sources is positioned a wing reflector element, these elements are provided in order to project a maximum amount of light possible through the apertures of the front plate. To an observer looking at the panel from outside, an effect is created similar to that of a starry night sky.

However, in this solution, the light sources remain visible through the apertures in the front plate over all angles. As a result, a true (spatially dynamic) sparkling effect, in which point sources across the display give the impression of disappearing and appearing briskly as one changes position, is not created.

Furthermore, it may be desirable to provide a sparkling effect in combination with conventional functional illumination for lighting the space within which the lighting device is placed. This allows the appealing aesthetic effect of spatially dynamic sparkling to be created in environments and scenarios where, for reasons of space or of aesthetics, it is not practical or desirable to provide both a lighting device for functional lighting in addition to a dedicated decorative unit for providing the sparkling effect. Such sparkling might also provide an appealing or desirable bonus feature to an otherwise predominantly functionally-targeted lighting product.

There is a need in the art therefore for a lighting device capable of creating a true spatially dynamic sparkling light effect, but which is more compact than solutions requiring light sources to be installed at a distance from a sparkling panel, and which is cheaper, lighter and simpler than alternative lead glass panel solutions, and which is further capable of providing a functional light source for lighting a space.

SUMMARY OF THE INVENTION

The invention is defined by the claims.

According to an aspect of the invention, there is provided a lighting device for simultaneously providing functional lighting for illuminating a space and a dynamic sparkling or glittering effect. The lighting device comprises an exposed outer surface and at least one primary light source disposed within a chamber. The chamber has an internal surface arrangement including at least a first surface portion and an opposing second surface portion, the at least one primary light source being located on the first surface portion. The second surface portion being translucent and delimiting a plurality of light exit areas having a higher transmittance than the second surface portion. The at least one primary light source is arranged to illuminate the plurality of light exit areas delimited by the translucent second surface portion in order to create a plurality of secondary light sources located on the exposed outer surface of the lighting device, each of the plurality of secondary light sources having a light-emitting surface with an anisotropic luminance.

In the context of the present invention, an exposed outer surface is a surface that is at the outside of the lighting device and that is directly observable by an observer. This means that when an observer is looking in a direction towards the exposed outer surface he can observe the exposed outer surface without the interference of any other component of the lighting device. Because the plurality of secondary light sources is located on the exposed outer surface of the lighting device, these secondary light sources are also directly observable by an observer. An observer looking in a direction towards the exposed outer surface can observe the light-emitting surface of each secondary light source without the interference of any other component of the lighting device.

Each of the plurality of secondary light sources has a light-emitting surface with an anisotropic luminance. The term "luminance" denotes the luminous intensity per unit area of light travelling in a given direction. The luminance indicates how much luminous power will be detected by an observer looking at the light-emitting surface from a particular angle of view. Luminance is thus an indicator of how bright the light-emitting surface will appear (the term "brightness" being typically used to refer to the subjective impression of luminance). When the luminance of a light-emitting surface is anisotropic, the apparent brightness of the light-emitting surface depends on the observer's angle of view.

In the context of the present invention, a light source can be a "real" light source or a "virtual" light source. The aforementioned secondary light sources that are created upon illumination of the light exit areas delimited by the translucent second surface portion are virtual light sources. The one or more primary light sources can be real or virtual light sources.

In operation, the aforementioned lighting device creates for an observer an effect of light sources that significantly diminish or alter in intensity or spectral composition across a range of different positions relative to the lighting device.

Each of the real or virtual primary light sources that is located on the first surface portion creates a plurality of virtual secondary light sources on the exposed outer surface of the lighting device. When looking at the exposed outer surface of the lighting device, and dependent on the position relative to the exposed outer surface, an observer will either have a direct line of sight with the primary light source that creates the plurality of secondary light sources, or no direct line of sight with the respective primary light source.

By providing a translucent surface portion in optical communication with at least one primary light source, said translucent surface portion delimiting or defining holes or other light exit areas, the device is capable of generating both a sparkling effect (by means of light exiting through the light exit areas within the surface portion) and a source of functional lighting (by means of light passing through the much broader and more expansive translucent surface portion).

For the sparkling effect, the plurality of secondary light sources created by a primary light source ideally emits light in alternately spaced angular ranges, being a plurality of angular ranges or angular distributions that are non-overlapping and also non-adjacent, or non-proximate. When an observer is within one of these alternately spaced angular ranges, he has a direct line of sight with the primary light source that creates the plurality of secondary light sources when he is looking in the direction of the lighting device. When the observer is not within one of these alternately spaced angular ranges, he has no direct line of sight with the respective primary light source.

In embodiments, there may be provided both a plurality of primary light sources, and a plurality of light exit areas, to thereby provide a more expansive and noticeable sparkling effect. The translucent second surface portion may extend across a broad region, for instance all or most of, a visible front surface of the lighting device for example.

Under such an arrangement, when a primary light source, light exit area and observer's eye are all in alignment, light emitted by the primary light source falls incident at the observer's eye, and he perceives, emanating from the position of the light exit area, a bright point or spark of light. If the observer moves his position slightly, such that said alignment is broken, at least a significant portion of the light from the respective primary light source ceases to fall incident at the observer's eye and the bright light spot gives the appearance of vanishing from view, or at least significantly diminishing in intensity. When replicated across the whole front surface of the device, an effect is created for an observer of almost instantaneously appearing and disappearing bright light sources, occurring across a wide range of different positions across the device, and set against a background illumination of an intensity more diminished than that exiting through the light exit areas. In this way, a true spatially dynamic sparkling light effect is created.

The sparkling effect thus described is visible against the background light provided through the translucent second surface portion by consequence of the fact that the transmissivity or transmittance of the light exit areas is in all cases higher than that of the translucent second surface portion delimiting them. Hence the 'background' light visible through the translucent second surface portion appears dimmer or less intense than light exiting through the light exit areas. This latter light hence stands out against the constant (functional) background illumination provided by the translucent surface, and the sparkling effect is apparent.

According to one or more embodiments, one or more internal surfaces of the chamber may be at least partially reflective and optionally said internal surfaces may be bounding internal surfaces. These surfaces may for example be white surfaces, and adapted therefore to reflect the entirety of the spectral composition of any light emitted by at the least one primary light source which falls incident at them. They may further be adapted to reflect all or only a portion of this light (i.e. to be fully or partially reflective).

In other examples, said internal surfaces may be adapted to reflect only a portion of the spectral composition of any light falling incident at them. They may for example be adapted to absorb or to only reflect spectral frequencies corresponding to particular visible colors of light. According to these examples, light exiting the chamber directly from the primary light source may have a different visible color to light exiting indirectly via reflection from said internal surfaces. These surfaces too may be either fully or partially reflective.

Further to this, in some examples, the translucent second surface portion may be adapted or configured, either independently or in combination with one or more additional optical elements to transmit only light of a particular range or selection of spectral frequencies, for example only light corresponding to a particular visible color. The translucent second surface portion may be colored or diffusive for instance, or a color filter or diffuser may be coupled or mounted to the interior or exterior of the second surface portion relative to the chamber.

In these or further examples, said internal surfaces may comprise specularly reflective surfaces such as mirrored surfaces.

According to one or more embodiments, the first surface portion of the chamber may be a mounting surface portion, wherein the at least one primary light source, for example a plurality of primary light sources, is mounted to said mounting surface portion.

In accordance with this example, the at least one primary light source may for example be a solid state light source, and the mounting portion may house or carry for instance a PCB for electrically mounting the solid state light source.

In one example for instance, the lighting device may comprise a panel or boxed-shaped lighting device, wherein the translucent second surface portion comprises or is comprised by a front panel element, and wherein the mounting surface portion comprises or is comprised by a rear panel element.

However, in accordance with other examples, the at least one primary light source may comprise for instance a conventional or LED retrofit light bulb, being electrically and mechanically coupled to a conventional light fitting. In this case, a dedicated mounting portion may not be required. However, in all cases, the at least one primary light source is arranged to illuminate the translucent second surface portion.

According to this or other examples, the translucent second surface portion may for instance at least partially define a spherical or elliptical shaped chamber which extends around or encloses the at least one primary light source. More generally, the translucent second surface portion may at least partially define a body which envelopes the chamber. This body may have a regular shape such as a spherical or elliptical shape or may have a free-form shape.

It is noted that in embodiments, the at least one primary light source may be arranged to illuminate said translucent second surface portion indirectly, for example in optical collaboration with one or more further elements, for instance one or more mirrors or other reflective elements or arrangements. The at least one primary light source is in all cases arranged and configured to be in optical communication with the translucent second surface portion, so that, whether directly or indirectly, it is arranged to illuminate the translucent second surface portion.

In order to provide suitably bright functional light, it may be necessary to configure or adjust the one or more primary light sources to emit light at an intensity or brightness which, were it permitted to pass unimpeded through the light exit areas, would be of a dangerous or at least uncomfortable brightness for an observer looking at the lighting device.

Accordingly, in accordance with one or more embodiments, the lighting device may further comprise one or more optical elements each arranged in optical communication with one or more of the plurality of light exit areas, wherein each optical element is adapted to absorb or deflect a portion of the light incident at them. The optical elements may be arranged for instance along one or more optical axes extending between one or more of the primary light sources and one or more of the light exit areas. In this way, light from the one or more primary light sources falls incident at said optical elements on its path toward the light exit areas. The effect of the optical elements may be to reduce the intensity or apparent brightness of the light exiting through the light exit areas, i.e. to reduce the total optical flux passing through one or more of the light exit areas.

In particular examples, the optical elements may comprise light filters, configured to absorb a portion of the light passing through them. In other examples, the elements may comprise semi-reflective elements, such as partial mirrors, adapted to reflect a portion of the light incident at them.

Each of said optical elements may in examples be directly coupled to or be comprised by one or more of the plurality of light exit areas.

In accordance with one or more embodiments, the one or more primary light sources is a plurality of primary light sources, said plurality of primary light sources comprising at least a first set of primary light sources and a second set of primary light sources, the first set of primary light sources being configured to emit light that is directly incident at one or more of the plurality of light exit areas, and the second set of primary light sources being configured to emit light that is not directly incident at any of the plurality of light exit areas. In examples, this may allow light delivered directly through the light exit areas to have differing optical properties to other light delivered directly to the translucent second surface panel or delivered only indirectly to the light exit areas. This may for instance enable a sufficiently high intensity or brightness of light to be emitted from the device as functional light, while avoiding the situation that any light directly emitted from a primary light source through a light exit area has an intensity which is uncomfortably or dangerously high. The first set of primary light sources may be configured to emit light which is dimmer, or appears dimmer, than the second set of primary light sources for instance.

In particular examples, the output intensity of each of the first and second sets of primary light sources may be independently adjustable. In this way the intensity of the functional light output might be increased for instance, without correspondingly increasing the intensity of light directly emitted through the light exit areas. Their respective output intensities may be adjustable while the device is in operation for instance. One or more of the output intensities may be adjustable by means of a user control element or user input element.

In some examples, the lighting device may further comprise a controller configured to adjust the output intensity of the first set of primary light sources in dependence upon the output intensity of the second set of primary light sources. The controller might for instance be configured to reduce the output intensity of the first set of primary light sources in response to increases in the output intensity of the second set of primary light sources.

According to these examples, the output intensity of the second set of primary light sources might be configured to be user defined or controlled for instance, so that the lighting device provides fully adjustable functional light output, while automatically adjusting the intensity of the sparkling effect, for instance to avoid dangerous or uncomfortable levels of radiant flux exiting any given light exit area.

In accordance with one or more embodiments, the lighting device may further comprise a translucent front panel positioned directly opposing an exterior side of said translucent second surface portion, and a space in between the translucent front panel and the translucent second surface portion.

In particular examples, said space may be configured to receive and/or at least partially retain a light transmissive fluid. Such an embodiment provides a particularly interesting and striking aesthetic effect, as light is emitted from the lighting device via the thus provided layer of fluid. In examples, said fluid may comprise smoke or another at least partially light transmissive gas or gas mixture.

According to one or more further examples, said same aesthetic effect may similarly be provided without the structural requirement of an additional front panel to contain the fluid. For example, the fluid may instead simply be continuously passed or transported across the exterior side of the translucent second surface portion, or directed at said exterior side, or wherein some other mechanical or structural feature enables a constant presence of fluid to be maintained across the front of the panel.

In accordance with such an example there may hence be provided a lighting device arrangement comprising a lighting device in accordance with any example embodiment described; and a fluid delivery means for projecting, propelling or transporting a light transmissive fluid in front of an exterior side of the translucent second surface portion.

The fluid delivery (or supply) means may in examples generate a fluid for propelling or transporting in front of the translucent second surface portion, or may be adapted to propel or deliver fluid already provided for example.

In one or more embodiments, the one or more primary light sources may each have a respective optical axis, and the light exit areas may be formed or arranged such that none lie on any of said respective optical axes. For example, the one or more primary light sources may be arranged at positions laterally displaced from the positions of the light exit areas, where laterally displaced means displaced in a direction parallel with the translucent second surface portion.

In this way the primary light sources may be arranged such that an observer looking directly through a light exit area is unable to see the arrangement or pattern of primary light sources disposed within the chamber. This adds to the overall aesthetic effect of the lighting device, which is to provide to an observer, on moving past the device, a sparkling effect which is surprising and mysterious, where the source of the glittering lights remains obscure.

In examples, the plurality of light exit areas may comprise a first pattern of light exit areas and the at least one primary light source is a plurality of primary light sources that comprises a second pattern of primary light sources, the second pattern of primary light sources being different to the first pattern of light exit areas, wherein at least one of the first pattern of light exit areas and the second pattern of primary light sources optionally is an irregular or semi-random pattern. In this way, the light exit areas and the primary light sources may be respectively arranged so as to not align or coincide with one another, thereby helping to keep the arrangement of primary light sources hidden from an observer.

By utilising an irregular or semi-random pattern, greater freedom is afforded in the arrangement or configuration of the light exit areas, since these may (theoretically) be configured according to any desired pattern, while substantially avoiding alignment with the primary light sources.

In accordance with one or more embodiments, the at least one primary light source may comprise a first set of primary light sources adapted to emit light of a first spectral composition, and a second set of primary light sources adapted to emit light of a second spectral composition, wherein the chamber is arranged to at least partially mix the light of the first spectral composition with that of the second spectral composition.

A spectral composition of light may refer to a spectral profile of the light, meaning the composition of component frequencies of radiation which form the light. In examples, the light may have a spectral composition which comprises one or more frequency components falling outside of the visible spectrum. In some cases, spectral composition may imply a particular color of light, or may imply light that is a combination of colors, such as white light of a particular color temperature.

Hence according to these embodiments, the lighting device may be adapted to emit light of different colors. In particular, the lighting device may be configured to emit directly via one or more of the light exit areas light of just a first and/or second spectral composition for instance, while being configured also to emit via the translucent second surface portion and/or one or more light exit areas light comprising a mix of both the first and second spectral compositions. The mixed light may constitute a functional light for illuminating a space for instance, while the directly emitted light of just the first or second spectral composition may form all or part of the sparkling effect appearing on top of the background functional light for example.

In one or more particular examples, the plurality of primary light sources may comprise a first set of primary light sources adapted to emit red light, a second set of primary light sources adapted to emit green light and a third set of primary light sources adapted to emit blue light. The chamber according to this example is configured to mix the light of all three sets, thereby generating a white light source which is emitted from the device at a range of propagation angles via the translucent second surface portion and also possibly the light exit areas. In addition, each of the first, second and third sets of primary light sources may be arranged within the chamber to emit light directly toward one or more of the light exit areas, so as to allow direct exit from the chamber light of just a single one of the three colors. These directly emitted rays or beams may form red, green and/or blue sparkling effects, visible against an apparently white background (functional) light.

In certain examples, the first set of primary light sources may be arranged to emit light directly incident at the light exit areas and the second set of primary light sources may be arranged so as only to only deliver light to the translucent second surface portion. In this way, the functional light may be provided having a different color to the sparkling effect.

According to one set of examples of these embodiments, the lighting device may further comprise further optical elements together adapted to direct light emitted by the first set of primary light sources through the light exit areas of the translucent second surface portion at a first range of propagation angles, and to direct light emitted by the second set of primary light sources through the light exit areas at a second range of propagation angles, and wherein optionally the further optical elements comprise light blocking elements adapted to deflect or absorb at least a portion of the light emitted by the first and/or second sets of primary light sources.

In these examples, an observer may observe light of a first color when looking at the device from a first range of angles relative to the device, and may perceive light of a different color when looking from a second range of angles relative to the device. When an observer changes his position relative to the device, he may observe the first color when moving and facing in a first set of directions relative to the device, and may observe the second color when moving and facing in a second set of directions relative to the device.

In some examples of the above embodiment, the further optical elements may comprise light blocking elements adapted to deflect or absorb at least a portion of the light emitted by the first and/or second sets of primary light sources. These elements together provide the effect of directing light of the first spectral composition through light exit areas across the first range of propagation angles, and directing light of the second composition across the second range of angles.

Additionally or alternatively, in some examples the first set of primary light sources may be arranged at a first distance from the translucent second surface portion, and the second set of primary light sources may be arranged at a second distance from the translucent second surface portion, wherein the optical elements are disposed in-between the first set of primary light sources and the second set of primary light sources.

In this case, the first range of angles may comprise the second (or vice versa), i.e. the second range lies within the first. Here, the set closer to the light exit areas may emit light across the broader first range of angles, and the furthermost set, may emit light which, by means of the optical elements, is directed through the light exit areas only across a narrower range of angles. The effect of this is that over said narrower range of angles, an observer may perceive light of two different colors (corresponding to both the first and second spectral compositions), and over the remaining angles, may perceive light only of the second or first color.

In any of the above examples, the primary light sources may alternatively comprise more than two sets of spectrally differing primary light sources, for example three or more sets of primary light sources, each set comprising sources adapted to emit light having a spectral composition different from the other sets.

Furthermore, in examples of the above or any other embodiment, one or more of the primary light sources may be adapted to individually emit light having a first spectral composition across a first range of propagation angles, and to emit light having a second spectral composition across a second range of propagation angles. Alternatively, said one or more primary light sources may not emit the different spectral compositions at different angles, but may simply be adapted to emit light of the first composition across a first portion of a light emitting surface and light of the second composition across a second portion of a light emitting surface. The different spectral compositions may imply light of differing colors. In either of the above cases, said one or more of the primary light sources may be adapted to emit light exhibiting a color gradient.

In particular examples, one or more of the primary light sources may comprise a single light emitting element adapted to emit light of more than one color, or may comprise a light source having multiple individual elements configured to operate co-operatively to produce light of more than a single color. In either case, these multiple colors may be generated singly (in isolation), or simultaneously with one another. In certain examples, one or more of the primary light sources may comprise an RGB LED and/or may comprise a co-operative assembly of one or more of each of a red LED die, a green LED die and a blue LED die. In examples, the intensity of each LED die or light source may be individually adjustable and/or each individual LED of a multiple LED light source (for instance) may be individually addressable.

According to one or more embodiment, the translucent second surface portion may comprise one or more shaped opaque regions for patterning the light output from the lighting device and/or the lighting device may comprise a front panel element comprising one or more shaped opaque regions for patterning light output from the lighting device.

The opaque regions may be shaped for instance so as to pattern the light in the form of symbols, letters or numerals for example. Such an embodiment might for instance be advantageously applied within a signage application, where it may be desired to pattern the output light (or shape the opaque regions) so as to communicate information or messages to an observer.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting device configured to provide both functional lighting for illuminating a space, and simultaneously to present a spatially dynamic sparkling light display.

The device comprises an exposed outer surface and a chamber containing one or more primary light sources. The chamber has an internal surface arrangement including at least a first surface portion and an opposing translucent second surface portion, wherein the at least one primary light source is located on the first surface portion. The one or more primary light sources are arranged to direct light in the direction of the translucent second surface portion, and in the direction of a plurality of light exit areas delimited by the translucent second surface portion. The light exit areas each have a higher transmittance than the surrounding translucent second surface portion. This creates a plurality of secondary light sources located on the exposed outer surface of the lighting device, wherein each of the plurality of secondary light sources has a light-emitting surface with an anisotropic luminance.

Light incident at the translucent second surface portion is transmitted from the device at a higher level of attenuation than light incident at any of the light exit areas. The relative transmittance of the light exit areas and the surrounding translucent second surface portion is configured to ensure sufficiently high luminous contrast between the apparent intensity of a virtual secondary light source which is in alignment with a primary light source and an observer's eye, and the apparent luminosity of regions of the exposed outer surface of the device immediately surrounding the virtual secondary light source. This ensures that only when an observer's eye is in alignment with a respective light exit area and with a primary light source the primary light source is visible at its full intensity. As soon as this alignment breaks, the primary light source appears to the observer to vanish from view, or at least to significantly diminish or alter in intensity. It is this effect which provides the spatially dynamic glittering light effect.

Figure 1:
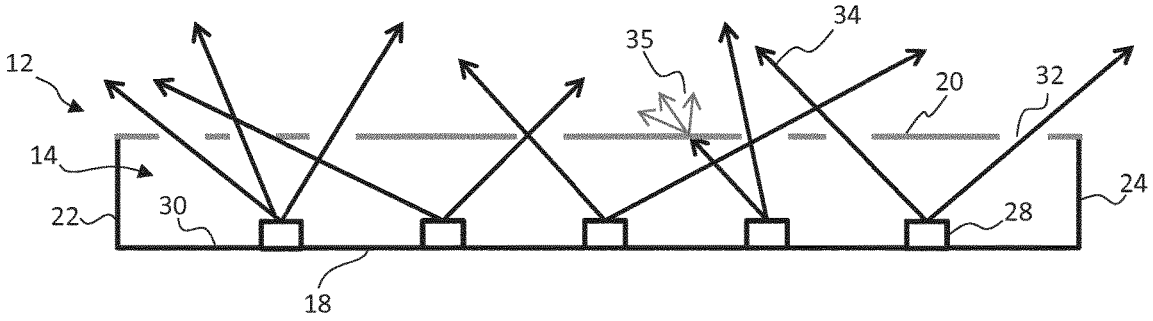
FIG. 1 schematically depicts a first example embodiment of the invention.

FIG. 1 schematically illustrates a first example of a lighting device 12 in accordance with an embodiment of the present invention, which is demonstrative of the general concept of the invention embodied by all examples of the invention. The lighting device 12 comprises a panel or box shaped frame or structure whose interior comprises a chamber 14 which is bounded by a back panel 18, side panels (of which only two 22, 24 are shown in FIG. 1), and translucent front panel 20. The translucent front panel in accordance with this example is translucent across its full dimensions, and fully constitutes the translucent second surface portion for the purposes of the invention. The panel or box embodiment of FIG. 1 comprises six internal surfaces, which include the respective interior surfaces of each of: the back panel 18, the translucent front panel 20, first side panel 22, and second side panel 24 (plus two additional side panels, not shown). It is emphasized that this particular shape, having an internal surface arrangement comprising six surfaces is shown by way of example only, and other arrangements comprising for example a triangular or other polygonal shaped device may also be used.

A plurality of primary light sources 28 disposed within the chamber are located on a first surface portion, being a mounting surface portion 30, which forms a portion of the inner surface of back panel 18, i.e. the surface facing the chamber 14 by way of example only. In other examples, the primary light sources 28 may be provided, fixed or otherwise carried within the chamber 14 by any other suitable means. The primary light sources 28 are spatially separated from the translucent front panel 20 and are spatially separated from each other, such that the back panel 18 may comprise a plurality of point light sources spatially separated by dark areas, i.e. areas in which no light sources are present. Such distributed primary light sources 28 may generate the desired sparkling effect as will be explained in more detail below.

The primary light sources 28 are operable to emit light in a range of propagation angles in directions toward a plurality of light exit areas 32 formed at various locations through translucent front panel 20. The light exit areas 32 are configured having an optical transmittance which is greater than the surrounding translucent front panel 20 which defines or delimits them. As shown by arrow 34 in FIG. 1, light incident at a light exit area is transmitted directly through said light exit areas.

In operation, the primary light sources 28 illuminate the light exit areas 32 delimited by the translucent front panel 20. This creates a plurality of secondary light sources located on the outer surface of the front panel 20, being an exposed outer surface of the lighting device 12. Each of these secondary light sources coincides with one of the light exit areas 32, and each has a light-emitting surface with an anisotropic luminance.

The arrangement of a plurality of primary light sources 28 on a mounting portion 30 may be such that each primary light source is horizontally or laterally displaced from any light exit area 32 of the front panel 20. The effect of this is that an observer looking through a light exit area, in a direction of the optical axes of the primary light sources, is not able to observe the full arrangement of the primary light sources lying beneath. This adds to the interest and enjoyment of the resultant lighting device, since the mechanical workings providing the sparkling effect are not immediately apparent.

According to these or other examples, the primary light sources might be arranged according to a first regular pattern, and the light exit areas arranged according to a second different regular pattern. The patterns may differ in the pitch between neighboring primary light sources and/or light exit areas, or may differ simply in their relative alignment, so that the elements of the first pattern are arranged to interleave with the elements of the second pattern.

Alternatively, the light exit areas and/or the primary light sources may be arranged according to an irregular pattern, such as a random or semi-random pattern. The advantage of using such a pattern for one of either the light exit areas or the primary light sources is that this affords a degree of freedom in the arrangement of the other, since substantial non-alignment of primary light sources and light exit areas may be expected to follow automatically from the irregularity of the pattern used. For instance, by arranging the light exit areas (or window elements) semi-randomly, then this allows the primary light sources to be arranged according to a standard regular array configuration, which may be substantially cheaper and easier to manufacture.

By random or semi-random is meant a pattern or arrangement for example in which the separation distance, pitch or relative angular arrangement of subsequent or adjacent elements in the pattern (primary light sources or light exit areas) differs or varies in a non-regular way. In particular examples, the primary light sources and/or light exit areas may be arranged to follow a Voronoi-like pattern or arrangement.

The primary light sources 28 in some embodiments may be provided in a regular N×M array (in which M, N are positive integers), an irregular array, or may be positioned in an arbitrary arrangement.

In at least some embodiments, the primary light sources 28 may be, or may comprise, solid state light sources, such as LEDs. Use of LEDs provides for high energy efficiency and also relatively sharp directionality of emitted light. The primary light sources 28 may be provided mounted via a Metal Core Printed Circuit Board (MCPCB). Flip-chip LEDs may be provided mounted directly onto a PCB. Other suitable mounting arrangements of the primary light sources 28 will be immediately apparent.

As shown by arrows 35, light incident at the translucent front panel 20 is attenuated as it passes through the panel (to a greater extent than light passing through light exit areas 32), with the result that this light appears dimmer or less intense than light 34 emitted via the light exit areas. This light may provide a 'background' illumination suitable for lighting a space such as for example a room, while the light exiting directly via the light exit areas appear to an observer (whose eye is in the appropriate alignment with the respective light source) as bright spots of light superposed on top of the background illumination. These bright spots coming into and out of alignment as the observer moves create a spatially dynamic glittering or sparkling effect on top of a relatively dimmer background layer of illumination. The overall effect is comparable to the sparkling effect generated by snow illuminated by sunlight.

As noted, light transmitted from the device through the translucent front panel, may in accordance with example embodiments provide a source of functional illumination for illuminating a space. Accordingly, for this (or any other) embodiment, the plurality of primary light sources 28 may be arranged or adapted to produce white light, or configured to produce spectral components which may be mixed to form white light.

The light exit areas 32 may, by way of non-limiting example, constitute holes, or fully or partially light transmissive window elements formed for instance of a light transmissive material having an optical transmittance greater than that of the translucent front panel.

In example embodiments, the light exit areas 32 may be provided by holes formed at an angle (or different angles) through the translucent front panel 20 cardboard. By providing such holes aligned at angles non-parallel with optical axes of the primary light sources 28, the range of angles over which the sparkling light effect created by the device is visible to observers is accordingly restricted. This may be used in examples to direct the light effect to be visible only (or predominantly) at relatively narrow angles to the panel for instance, such that the panel is visible to observers far away from the panel, walking or positioned in relatively acute angles to the front of the lighting device. This may attract potential customers to the lighting panel from far distances away for instance.

Alternatively, the light exit areas may in some examples be formed simply by regions of the translucent front panel where the material is thinner than in the remainder of the panel.

The translucent front panel 20 may in examples comprise a translucent glass plate, having a layer of black (or other absorbing) paint applied to one side. The light exit areas may in this case be provided by non-painted areas of the glass plate, or areas where paint has been removed. A paint layer may be applied either to one side or to both sides of the glass plate.

According to one or more further non-limiting examples, the translucent front plate may comprise a transparent plate having a translucent layer printed (or in any other way provided or deposited) over one or both of the interior and exterior surface. Light exit areas may be provided by regions not covered with said layer, or regions where the layer has been subsequently removed. In particular examples, said translucent layer may be a white digital (inkjet) print layer. In one test, eight layers of white print provided a suitable degree of translucency. However, this is to be understood as exemplary only and it should be understood that the print layer may have any suitable thickness.

In certain examples, as in the case illustrated in FIG. 1, the translucent front panel may also act to partially diffuse the light transmitted through it, such that the light is spread or deflected across a range of outgoing propagation angles (shown by arrows 35). This may for example have the effect of giving the background functional light a Lambertian output profile.

Such partial diffusion also may act to further enhance the apparent contrast between light directly emitted via the light exit areas 32 and light emitted via the translucent front panel 20, since light emitted via the light exit areas 32 may have relatively greater directionality than light emitted via a diffusing front panel. This spreading of propagation angles, so as for example to generate a Lambertian output, may also help to improve the functionality of the light thus generated in illuminating a broad space.

In accordance with any embodiment of the invention, the translucent front panel may have any range of light transmittance. Light absorption by the translucent front panel 20 may range for example from 0.5% (high Q diffuser) to close to 100%. These numbers are provides purely by way of illustration and as will be understood by the skilled person, other specifications may alternatively be employed.

The optical efficiency of the system may vary depending upon the level of light output desired. For a soft glow-like functional light output, the efficiency may be as low as about 10%. However, for a more efficient functional light system, the system efficiency may be greater than 70%, for example 90%. Again, other specific technical constraints may equally be used, and these numbers are described by way of illustration only.

According to particular examples, the back panel 18 may be white, may be partially or fully reflective, may be adapted to only reflect light of particular colors, or may have any other surface properties. The back panel may, by way of non-limiting example only, comprise or consist of a printed circuit board (PCB), metal core printed circuit board (MCPCB) or metal plate for instance.

As discussed, the consequence of the described arrangement for an observer is that the observer, looking at the front (outward-facing) surface of the translucent front panel 20, sees a diffuse (functional) background light emanating from across the entirety of the front of the panel, and relatively brighter, narrower spots of light appearing superposed on top emanating from particular light exit areas 32. Each of said bright spots or sparkles appears visible to an observer only when there is complete alignment between the observer's eye, the light exit area in question and one of the primary light sources disposed within the chamber. When this situation does not exist, no direct optical path exists between the given primary light source and the observer's eye, and hence the relatively bright sparkle appears to vanish, and only the background light appears to emanate from the location of the respective light exit area.

Figure 2:
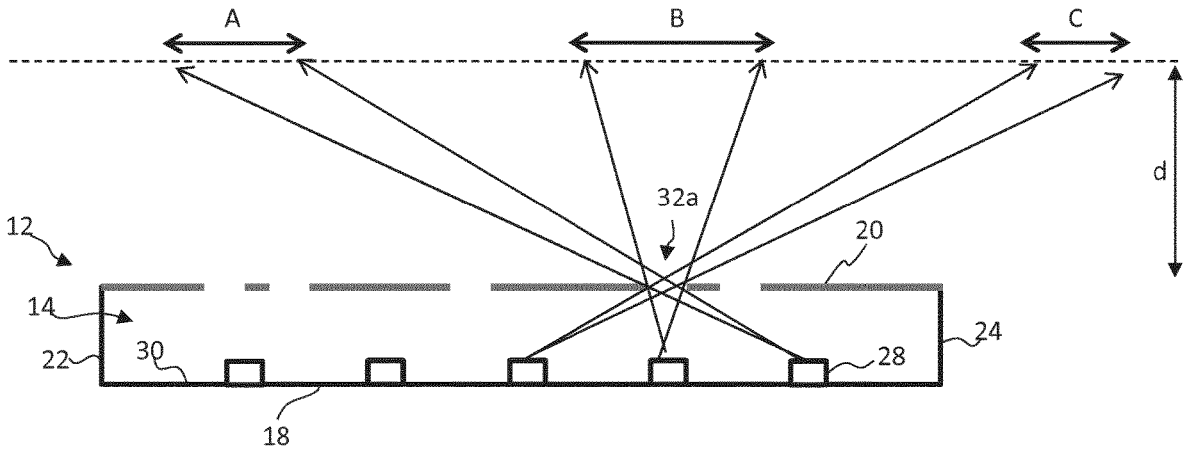
FIG. 2 schematically illustrates the optical effect created by embodiments of the invention.

This effect is illustrated more clearly in FIG. 2, which shows a schematic representation of the effect in relation to a particular light exit area 32*a* for an observer located at a distance d from the translucent front panel 20 of the device. The figure illustrates for each of the primary light sources 28 proximal to the light exit area 32*a* in question the maximal range of angles over which light emitted by the respective primary light sources is able to propagate through the light exit area and reach a point along the plane at distance d. The two arrows extending from each of the respective primary light sources represent the boundaries of the respective angular range.

The particular angular constraints of the three primary light sources 28 provide three discrete linear (as represented in this 2D schematic diagram) regions A, B, C along the distance d line within which light emitted by one of the primary light sources is able to directly enter the eye of an observer located at that position through light exit area 32*a*. Outside of regions A, B and C, no direct light is able to reach distance d through light exit area 32*a* from any of the three proximal primary light sources. Hence, outside of regions A, B and C, only a lower level of (mixed), background (functional) light is able to reach an observer's eye at distance d via exit area 32*a*, and so to an observer in those regions, the exit area does not appear as the source of a bright sparkle.

The same effect illustrated for light exit area 32*a* in FIG. 2 is replicated for each of the light exit areas across the panel, so that an observer moving relative to the panel along a line or plane at distance d is almost continually moving into and out of respective sparkle-visible zones corresponding to each of the light exit areas across the panel. The optical effect is the observance of different virtual bright spot light sources, emanating from the various light exit areas, constantly appearing and vanishing sharply in response to movement. This effect is referred to in this application, and in the art, as spatially dynamic sparkling or glittering; sparkling which is effected by movement.

It is noted that it can be seen from FIG. 2 that the intended sparkling effect is in fact only created for observers positioned at a certain minimum distance from the translucent front panel 20. At small distances from the front panel, the three visible zones converge together, such that for each light exit area, the area is visible across a broad, substantially continuous range of angles. In addition, because the areas converge, light from more than one primary light source may enter an observer's eye at a given time, potentially breaking the illusion of a single bright point source appearing to emanate from the light exit areas.

Figure 3:
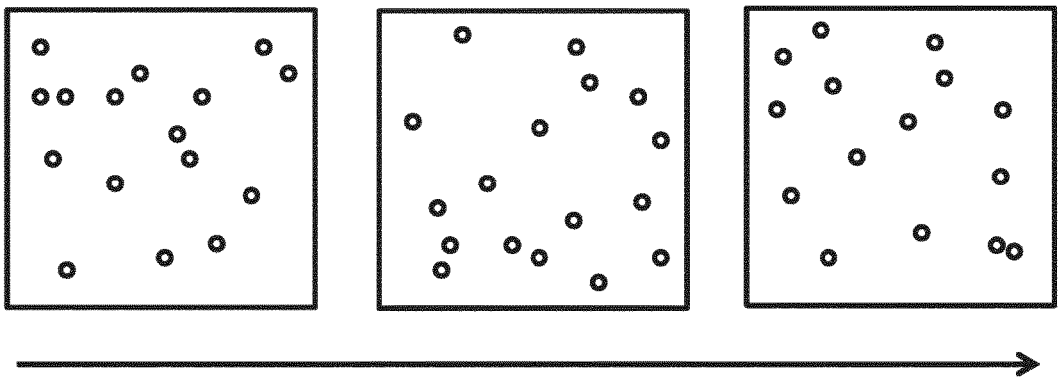
FIG. 3 illustrates the visible optical effect created by embodiments of the invention.

The sparkling effect created is illustrated schematically in FIG. 3 which depicts an example series of views of the device as seen from different positions along a fixed, or substantially fixed, distance from the panel. As an observer moves from a first position, to a second, certain of the visible bright spots disappear, and others appear in their place. As the observer moves, again, some of the bright spots appear to vanish from view, and different spots come instead into view. As the observer moves further along, spots which previously disappeared may reappear again, as they enter into a different visible zone for the respective light transmissive area.

The rate of change between the different 'frames' illustrated by way of demonstration in FIG. 3, with respect to lateral motion, may be engineered to have one of a range of different values, by configuring the relative positions of the light exit areas and primary light sources appropriately. Changes may for example be desired to be extremely rapid, such that transitions between 'frames' appears almost continuous or seamless. Alternately, a more disjointed, discrete twinkling or sparkling may be desired, in which the case, the rate of change might be engineered accordingly. The intended end use of the product may have to be considered, since this may affect the average rate at which a typical observer of the device may in practice be expected to move past it.

In examples, one or more of the internal surfaces of the chamber—formed, for the example of FIG. 1 by interior surfaces of the side panels 22, 24 and back panel 18—may be partially or fully reflective. Such partial or full reflectivity may assist in emitting from the chamber 14 a maximal level of functional light for illuminating the space within which the lighting device is placed. Reflective internal surfaces may provide a light mixing functionality—so that the chamber functions as a light mixing chamber—thereby improving the uniformity of the background, functional light emitted from the chamber.

According to particular examples, one or more of the internal surfaces of the chamber may be white, so as to thereby reflect light of spectral compositions corresponding to all color components of light. In further examples, one or more of the internal surfaces may be specularly reflective, or mirrored, surfaces.

As discussed above, in order to provide suitably bright functional light, it may be necessary to configure or adjust the primary light sources 28 to emit light at an intensity or brightness which, were it permitted to pass unimpeded through the light exit areas 32, would be of a dangerous or at least uncomfortable brightness for an observer looking at the lighting device.

Accordingly, in accordance with one or more embodiments, the lighting device may further comprise one or more optical elements each arranged in optical communication with one or more of the plurality of light exit areas, wherein each optical element is adapted to absorb or deflect a portion of the light incident at them.

Figure 4:
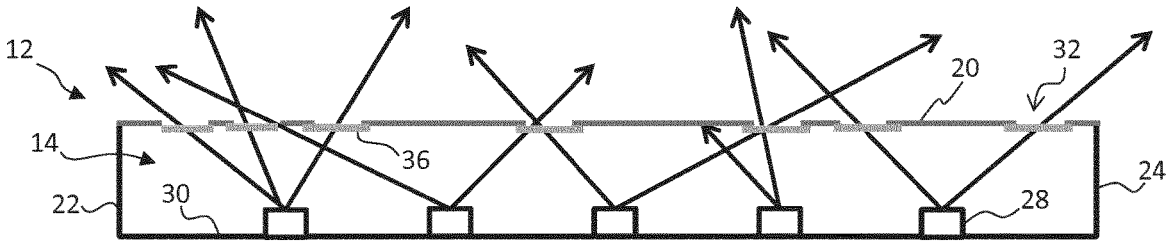
FIG. 4 schematically depicts a second example embodiment of the invention.

An example of such an embodiment is illustrated in FIG. 4. The example comprises the same lighting device arrangement as described in relation to FIG. 1, but wherein each of the light exit areas 32 is fully covered by a respective filter element 36, adapted to absorb a portion of the light incident at it, and transmit only the remaining portion. This has the effect of dimming the light which is emitted via each of the light exit areas 32, in comparison with the light being directly emitted from the primary light sources 28, meaning that the intensity of the primary light sources 28 may be increased to provide sufficiently bright functional illumination, while not at the same time risking exposure of observers to dangerous or uncomfortable levels of light through the light exit areas 32.

Although each of the filter elements 36 is configured to dim or attenuate the light passing through it, it is emphasized that in all examples, the transmittance of each of the light exit areas 32 (including the filter element 36) remains higher than that of the translucent front panel 20. This ensures that light emitted directly from a primary light source 28, through a given light exit area 32, remains relatively brighter than the background illumination and hence remains visible as a bright sparkle superposed on top of this background.

The filter elements may in examples comprise polarizing elements or other varieties of filter configured to reduce the intensity of light passing through them.

It is noted that, although in the particular example of FIG. 4, the light exit areas 32 are each covered by respective filter elements 36, in other examples different varieties of optical element might equivalently be used to achieve the same effect. For instance, light deflecting elements might be utilized to deflect, e.g. refract, a portion of the light that might otherwise be emitted through each of the light exit areas.

Figure 5:
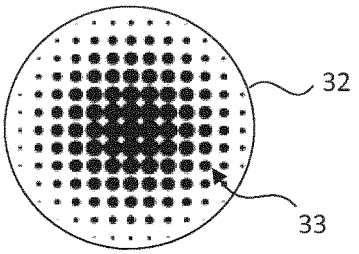
FIG. 5 schematically depicts an example light exit area as comprised by example embodiments of the invention.

Alternatively, light reflecting elements might be used, configured to reflect a portion of the light that would otherwise be emitted through each light exit area. This light is then re-directed back into the chamber 14, where it may be reflected by internal surfaces of the chamber before being propagated once again toward the translucent front panel and/or one or more of the light exit areas 32. In examples, the light reflecting elements may comprise or constitute mirror layers or elements, applied to light exit areas by foil or vapor deposition for example. In some examples, reflective elements may comprise reflective 'screen' print arrangements, wherein an otherwise clear window element is covered by a patterned screen or film applied to its surface. An example of such an arrangement is schematically depicted in FIG. 5 which shows a light exit area 32 comprising a white reflective 'screen' print (shown in black).

Although in the example of FIG. 4, each of the filter elements 36 is shown disposed directly beneath each of the light exit areas 32, fully covering the light exit areas 32, it is noted that in alternative examples, the filter element (or other optical element) might be alternatively arranged while still providing the same technical effect. In particular, the optical elements may be arranged in any of a variety of positions that falls along one or more optical axes extending between one or more of the primary light sources and one or more of the light exit areas. In this way, light from the primary light sources still falls incident at said optical elements on its path toward the light exit areas, but without the optical elements being positioned directly beneath the light exit area.

Additionally, in accordance with one or more examples the optical elements may be comprised by or partly constitute one or more of the light exit areas themselves. In particular examples, each of the light exit areas may be fully comprised by a respective filter element 36 for instance. In other examples, a light exit area may be formed by a window element partially comprised by a filter element, and partially comprised by an otherwise fully light transmissive portion.

The above described example embodiments incorporating additional optical elements constitute one set of example solutions to the problem of enabling high functional light output while preventing undesirably high sparkling light output. However, alternative solutions also exist. In accordance with one set of example embodiments, there are provided two distinct sets of primary light sources, each configured, or configurable, to emit light at a different intensity or luminance. The first set of primary light sources may be configured to emit light at a relatively high intensity, and arranged within the chamber so that said light is only directly incident at one or more portions of the translucent surface portion and not at any of the light exit areas. The second set of primary light sources may be configured to emit light of a relatively lower intensity, and arranged within the chamber so that said light does fall directly incident at one or more of the light exit areas. Only this lower level of light is able to directly exit the chamber via one of the light exit areas, and hence only this lower level of light will be able to fall directly incident at an observer's eye. This directly incident light generates the sparkle light effect.

Note that although only the lower intensity of light is utilized in forming the sparkle effect, this may still appear as a brighter spot compared to the functional background light by virtue of the relatively higher optical transmittance of each exit area compared to surrounding translucent front panel.

In particular examples, the first and second sets of primary light sources may be adapted to have fixed, pre-set absolute intensity values. In other examples, each of the first and second sets of primary light sources may have individually adjustable output intensities, such that a user may set the respective intensities at an appropriate level. It may be that in practice, the lighting device provides functionality for a user only to adjust the output intensity of the set not directly aimed light exit areas.

According to yet further examples, the lighting device may further comprise a controller, configured to adjust the output intensity of one set of primary light sources in dependence upon an output intensity of another set of primary light sources. Where the first set of primary light sources is arranged to avoid directing light onto any light exit area, and the second set of primary light sources is configured to emit light which does fall incident at light exit areas, then the controller may be configured to adjust the output intensity of the second set of primary light sources in dependence upon the first set of primary light sources. This may allow the output intensity of the first set of primary light sources to be user defined, while maintaining the relative intensities, or intensity difference, between the two sets of primary light sources at a fixed level or within some fixed range. The fixed relative intensity is important in ensuring that the bright sparkles remain bright enough to still be visible against the background illumination.

In some examples, the relative intensity or intensity difference itself may be configured to be user-adjustable. This may allow the apparent or relative brightness of the sparkles to be user-defined.

Although the above examples have been described in relation to two sets of primary light sources, as will be readily appreciated by the skilled person, the same concept may be applied to an arrangement comprising any number of different sets of primary light sources.

According to further examples, the balancing of relative intensities may be achieved simply through dimensional considerations. For example, the light exit areas may be pre-fabricated to have smaller or larger diameters in order to permit a greater or lesser total radiant flux through each area. Where a relatively brighter functional illumination is desired to be provided by the device, the light exit areas may be fabricated relatively smaller, while where a relatively dimmer level of functional light is acceptable or desirable, the light exit areas may be fabricated to be relatively larger.

Figure 6:
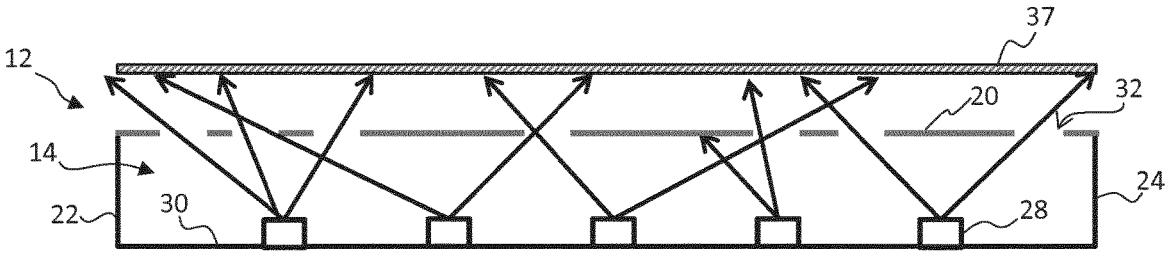
FIG. 6 schematically depicts a third example embodiment of the invention.

In FIG. 6 is illustrated a further example embodiment of the invention, comprising an additional panel element 37 arranged in front of the translucent front panel 20 of the lighting device chamber 14. The surface of this additional panel element 37 facing away from the translucent front panel 20 is the exposed outer surface of the lighting device 12. Light emitted from the chamber falls incident on the second panel 37, through which is it transmitted to illuminate the space, and to provide the sparkle effect. The additional panel provides opportunities for creating an alternative or additional aesthetic effect. In this example, the plurality of virtual secondary light sources is located on the surface of the additional panel element 37 that faces away from the translucent front panel 20, and no longer coincide with the light exit areas 32.

According to one set of examples for instance, the additional panel element 37 is a solid, continuous translucent panel, and light incident at the panel from the chamber is (partially) transmitted through its surface (and partially reflected). This may create a slight blurring or diffusing or clouding of the sparkle effect, which may be desirable for certain applications.

Figure 7:
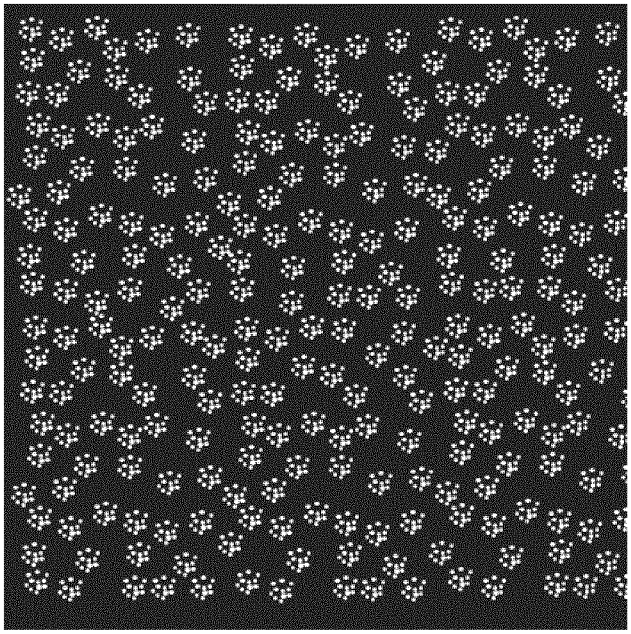
FIG. 7 schematically illustrates the optical effect created by the third example embodiment.

According to an alternative set of examples, the panel comprises a translucent panel having light transmissive holes formed through its surface. These holes allow for a further shaping or manipulating of the light exiting the lighting device. FIG. 7 schematically depicts one example 'view' from the front of the panel, where such an arrangement is used. Here the white dots no longer represent sparkles, but rather Lambertian light dots emitted through the provided light transmissive holes. In examples, the additional translucent panel may have smaller and/or (much) larger holes, providing a novel mixed effect of Lambertian output and superposed sparkling.

In examples, the additional translucent panel 37 may have a transmittance as low as 1%. However, any other level of transmittance, e.g. higher levels of transmittance, may also be used.

According to a further related example, the lighting device may be arranged or configured to project its light output (both Lambertian functional output and sparkle effect output) onto a further opaque surface, arranged opposing the exterior side of the translucent front panel, i.e. exterior to the chamber 14, either directly, or at an oblique angle. This surface may be provided as part of the lighting device of the invention, or may be provided separately, for example a surface forming part of the space or area within which the lighting device is installed such as a wall, ceiling or floor.

Further interesting aesthetic effects may advantageously be achieved by inventive use of further optical layers and elements. According to one example aspect of the invention for instance, there may be provided a lighting device assembly formed of a lighting device in accordance with any embodiment of the invention and a fluid delivery means for continuously providing a light transmissive fluid across the front of the panel. The light transmissive fluid might for instance comprise smoke or another partially light transmissive gas or vapor, such as dry-ice vapor. In further examples, the fluid may comprise a gas mixture, or may alternatively comprise a liquid for instance. This may create a relatively thick (relative to the translucent surface portion) additional translucent layer. This added depth creates a novel and interesting aesthetic effect. Such a layer preferably should allow all of the rays emitted from the translucent surface portion to remain visible.

The additional layer of fluid generates an interesting aesthetic effect for an observer, as both the functional illumination and the sparkling effect is only visible via an effective fluid filter. In the case that smoke or vapor is used, a 'misted' or 'cloudy' impression is formed for an observer of the lighting effects.

Also, since in most cases, the fluid will be non-static as the light passes through it, this provides an additional element of dynamism to the overall effect, as the observable pattern may move and shift as the observer looks, even while staying still in the same location relative to the lighting device.

In examples, the assembly might comprise a pump for continuously propelling or otherwise delivering the fluid across at least a portion of the front of the lighting device. In other examples, a containing or retention means may be additionally provided to at least partially retain the fluid in place once delivered. In this case, the delivery means may be adapted simply to top up the level of fluid, either automatically, or in response to user input.

According to further examples, a similar additional aesthetic effect may be created by means of a further layer of solid translucent material over the front translucent panel. This layer may be thicker relative to the front translucent panel of the lighting device. The further layer may also differ in its degree of transmittance and/or one or more other optical properties. These in combination with, for example, a greater relative thickness may provide an additional interesting aesthetic effect.

In a particular example, such a layer may include a low bulk, diffusive Polymethyl methacrylate (PMMA) plate for instance.

In one particular example, the embodiment of FIG. 6 is combined with a smoke or vapor delivery means configured to provide smoke or vapor to the space separating the translucent front panel 20 of the chamber and the second translucent panel element 37 opposite the translucent front panel 20. The second translucent panel 37 combines with the front translucent panel 20 to partially retain the smoke or vapor once delivered by the smoke or vapor delivery means. Other fluids might equally be used such as water or other liquids.

Figure 8:
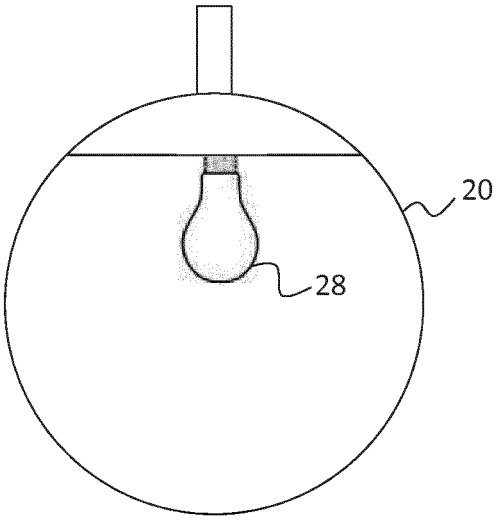
FIG. 8 schematically depicts a fourth example embodiment of the invention.

In accordance with embodiments of the invention, there may be provided a plurality of primary light sources (as in the example of FIG. 1) or just a single primary light source. FIG. 8 schematically illustrates an example lighting device adapted for use with a single primary light source, in particular for use with a conventional light fitting. The lighting device comprises an outer translucent spherical or ellipsoidal (or a non-regular variant) translucent casing 20 (providing the translucent surface portion) which delimits a spherical or ellipsoidal inner chamber. The translucent casing 20 delimits the plurality of light exit areas (not shown in FIG. 8). The lighting device is adapted to fit around a conventional light fitting configured for holding a conventional filament light bulb 28. In examples, an LED retrofit bulb may be used in order to increase the light output from the device, to enhance the sparkle effect and to improve the brightness of the functional light. In particular examples, and by way of illustration only, an Edison Screw (e.g. E27) LED bulb might be used.

In accordance with one or more embodiments, the lighting device may include multiple sets of primary light sources 28, each set of primary light sources being configured to emit light of a different spectral composition, for example corresponding to a different visible color of light. By including multiple colors of primary light sources, interesting aesthetic effects may be created.

In particular, the inner surfaces of the chamber 14 may be adapted to be fully or partially reflective so as to ensure at least partial mixing of light within the chamber. In this way, the interior of the chamber 14 acts as a mix-box and ensures that light exiting the chamber via the translucent front panel 20 (or indirectly through light exit areas 32) consists of a mix of the different colors of light generated within the chamber, while the light exiting directly from a given light source through a light exit area consists of light of just a single color. This may enable the lighting device to generate background functional light of a different apparent color to the sparkle effect superposed on top.

For example, in accordance with at least one set of embodiments, the chamber may contain a first set of red primary light sources (for example LEDs), a second set of green primary light sources and a third set of blue primary light sources. Each set of primary light sources may be configured to emit light directly through one or more light exit areas in order to provide a sparkling effect across at least a portion of the panel having a particular color of light. However, the three sets together may also be adapted to emit light in directions toward internal surfaces of the chamber, causing the three colors of light to mix or blend to thereby generate substantially white-colored light. This white colored light may then exit the chamber, via further reflection or deflection, through the translucent surface portion or one or more of the light exit areas.

The generated effect is that of substantially white background light having a sparkle effect superposed on top, at least a portion of which consists of red sparkles, at least a portion of green sparkles and at least a portion of blue sparkles.

Although red, green and blue have been described in relation to this embodiment, these are to be understood merely as exemplary and other colors may alternatively or additionally be employed. In addition, although an example comprising three sets of primary light sources has been described, it is to be understood that embodiments may equally employ a different number of sets, each of a different color, for example less than three or more than three.

In accordance with one variant of the above described set of embodiments, one or more of the sets of primary light sources may be arranged to emit light directly incident onto one or more light exit areas, while one or more sets of primary light sources may be arranged to only emit light onto one or more reflective internal surfaces of the chamber (for example one or more of the side or back panels). In this way, only the light of the former sets can exit the chamber directly and form the sparkle effect, while the light of the latter sets necessarily at least partially mixes within the chamber before exiting.

For example, red, green and blue primary light sources may be provided, but wherein only red primary light sources are arranged directly facing light exit areas, while the green and blue primary light sources are arranged facing toward the walls of the chamber. In this way, all three colors mix to form white background light, and only the red light exits to form the sparkle effect. The generated effect is that of red sparkles on a white background.

Again, these colors are described merely by way of illustration of the concept, and in further examples any combination of any number of colors might alternatively be used.

In accordance with at least a further set of embodiments, the device may be adapted to produce sparkle effects of different colors under different viewing angles. For example, the device may comprise a plurality of LEDs each having a light exit surface covered by a suitable phosphor to alter the spectral composition of the light produced by the LED as it travels through the phosphor layer. As is well-known per se, such arrangements typically produce color over angle (COA) effects due to the angular dependence of the length of the path of the emitted light through the phosphor layer, which may lead to the generation of a sparkle effect of different colors at different viewing angles of the emitted light.

Alternatively, and according to one group of embodiments, the device comprises at least two sets of primary light sources, each set adapted (as above) to emit light of a different spectral composition. Again, in practice, this may manifest itself as the emission of differently colored light by each set. In these embodiments, the device further comprises a plurality of optical elements which are together configured to direct light emitted by each of the different sets of primary light sources through light exit areas of the translucent surface portion at different ranges of propagation angles. The effect of this is that an observer may perceive sparkling lights of differing colors depending upon the angle at which he or she is standing relative to the front surface of the lighting device. Colors may change as the observer moves, so that some particular colors are seen only in certain angular regions. The various colors of sparkles appear superposed over a background light having a color comprised of a mix of each of the individual sparkle colors.

Figure 9:
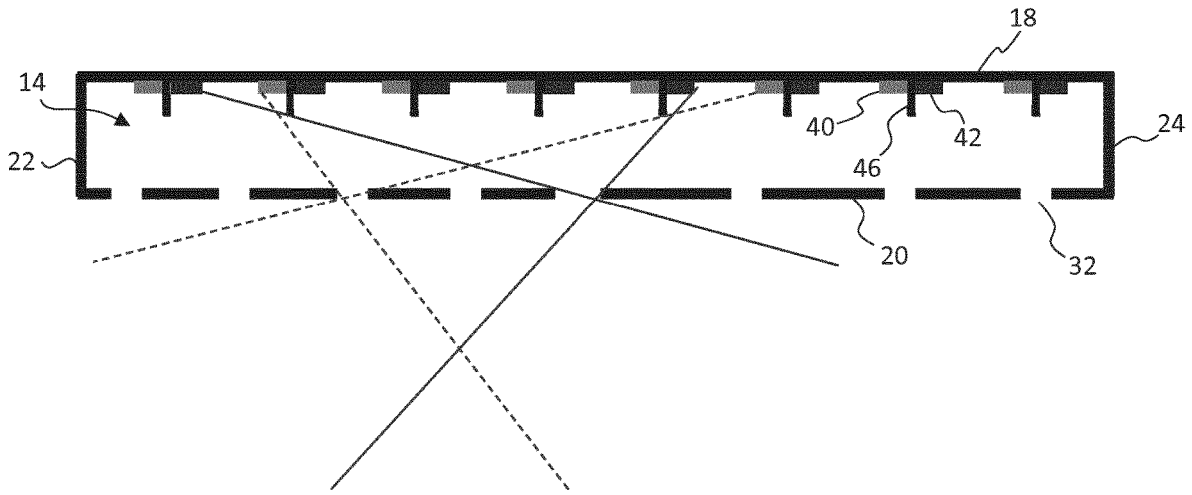
FIG. 9 schematically depicts a fifth example embodiment of the invention.

A first example of such an embodiment is schematically illustrated in FIG. 9. The device comprises a panel or box shape frame, having a back panel 18, translucent front panel 20, and side panels 22, 24 (plus two other side panels not shown) which bound an internal chamber 14 within which are disposed two sets of primary light sources 40, 42. The translucent front panel comprises light exit areas 32.

The first set of primary light sources 40 is adapted to emit light of a green color. The second set of primary light sources 42 is adapted to emit light of a red color. The primary light sources are disposed along the inner surface of the back panel 18 in pairs arranged at regular intervals, one of each pair belonging to each of the first set of primary light sources 40 and the second set of primary light sources 42. Disposed between the two primary light sources of each pair is a respective light-blocking element 46.

As illustrated in FIG. 9, the effect of the light blocking elements 46 is to constrain or limit the range of angles over which light emanating from each of the first set of primary light sources 40 and second set of primary light sources 42 is able to propagate. Within each pair, the light blocking element 46 prevents red (42) light being emitted past a particular maximal angle toward the left (as seen in the Figure) of the device. The light blocking elements 46 also define a range of acute angles very close to the device (both on the left and right) within which no light is visible from either of the two sets of primary light sources 40 and 42.

Figure 10:
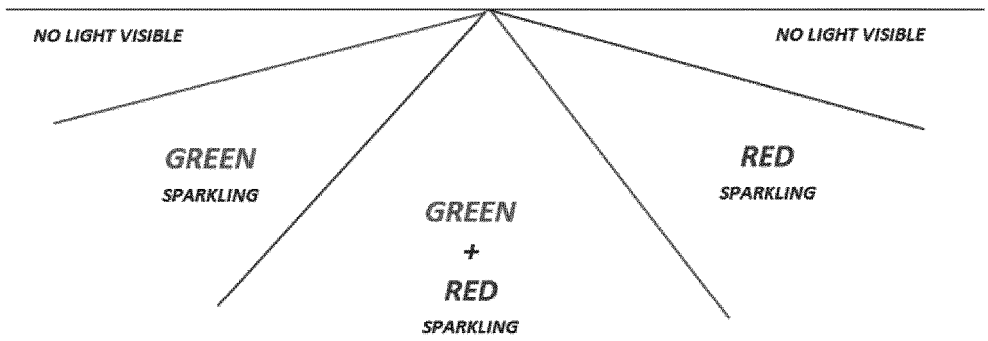
FIG. 10 schematically illustrates the optical effect created by the fifth example embodiment.

The angular constraints imposed by the light blocking elements are illustrated in FIG. 10. The diagram illustrates the color of sparkling light that an observer would see if facing (and moving—for sparkling) in a direction relative to the panel lying within the particular angular range indicated. For the left-most angular range, only green sparkling light is seen, for the right-most angular range, only red sparkling light is seen, and for the central angular range, both green and red sparkling lights are seen. Each color of sparkle may in examples appear superposed over a background light consisting of a mix of both colors.

Of course, as will be appreciated by the skilled person, red and green are merely examples of colors that could be used in accordance with this embodiment, and any other combination of colors may alternatively be used.

Figure 11:
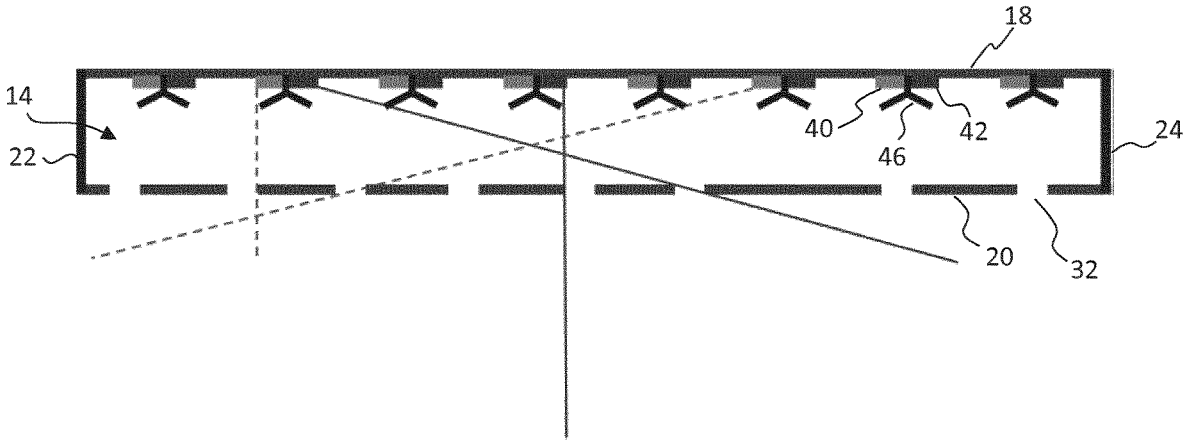
FIG. 11 schematically depicts a sixth example embodiment of the invention.

FIG. 11 shows a second example of this group of embodiments. The device comprises the same components as the example of FIG. 9, but differs in the shape of the light blocking elements 46 which here comprise angularly extending fork shapes, as opposed to simple vertical wall elements. The effect of the fork elements is to effectively provide complete isolation of the two colors of light, eliminating the central region of mixed green and red light which existed in the previous example.

Figure 12:
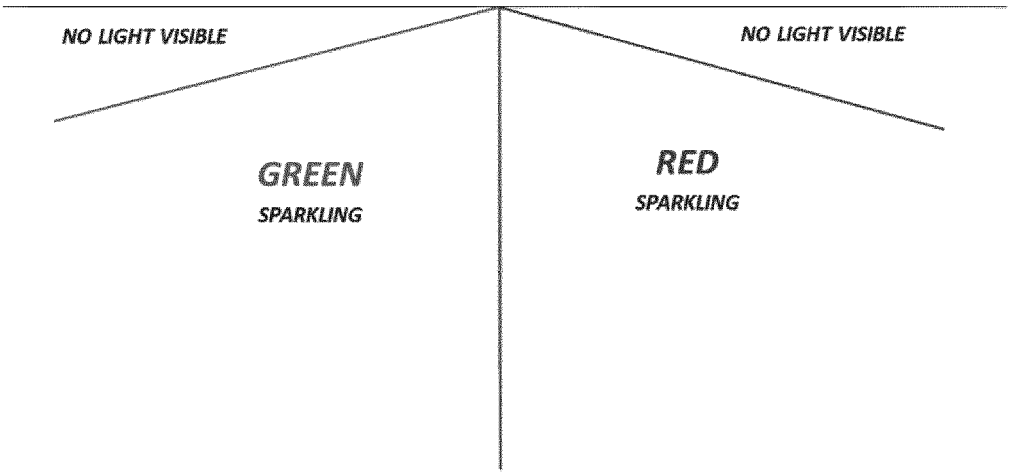
FIG. 12 schematically illustrates the optical effect created by the sixth example embodiment.

Instead, as shown in FIG. 11, just two angular regions are created, one to the left (as seen from the schematic view provided by FIG. 12), and one to the right, the first corresponding to angular directions in which green sparkling light will be observed and the second corresponding to angular directions in which red sparkling light will be observed. The effect of this is that when walking in any direction from left to right along the panel, only green (sparkling) light is seen, and when walking from right to left only red sparkling light is seen.

Additionally, when walking from left to right for example and looking forwards in a direction toward the panel, only green (sparkling) light is seen, but when walking in the same direction but looking backwards in a direction toward the panel, only red sparkling light is seen. The same effect in reverse would be observable when walking from right to left. Also, depending upon the particular configuration and specifications of the primary light sources, when walking in either direction but looking straight on toward the panel, i.e. along a line of sight exactly or substantially parallel with the optical axes of the plurality of primary light sources, a viewer may observe either no sparkles emitted from the panel, may observe sparkling light of both red and green light.

Again, red and green are merely exemplary colors which may be employed in accordance with this embodiment.

Figure 13:
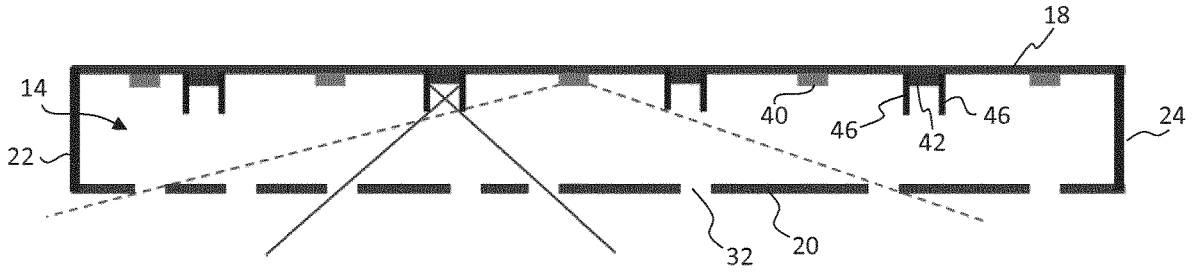
FIG. 13 schematically depicts a seventh example embodiment of the invention.

FIG. 13 shows a third example of this group of embodiments. This differs from the examples of FIGS. 9 and 11 in that the primary light sources are not arranged in directly adjacent pairs of differently emitting sources. Rather the primary light sources are arranged singly, with the first set of primary light sources 40 interleaved with the second of primary light sources 42, so that elements from the first set of primary light sources 40 and from the second set of primary light sources 42 are arranged alternately along the length of the back panel 18. As with the previous examples, the first set of primary light sources 40 is adapted to emit light of a spectral composition corresponding to the color green, and the second set of primary light sources 42 to emit light of a spectral composition corresponding to the color red. Each of the second set of light sources 42 is bounded on either side by a pair of light blocking elements 46, comprising linear vertical wall elements.

Figure 14:
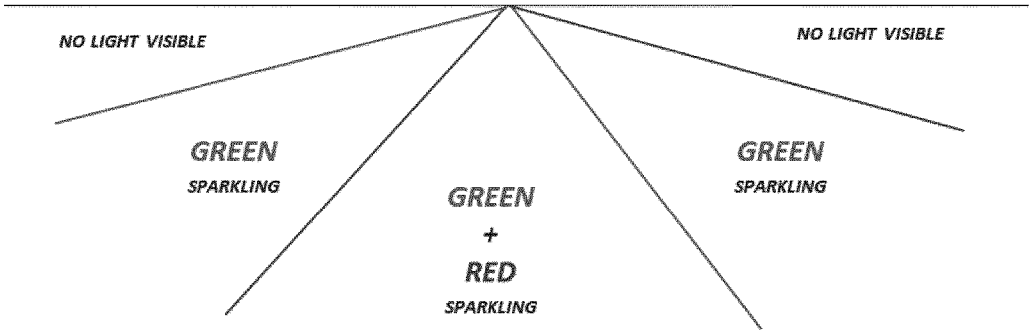
FIG. 14 schematically illustrates the optical effect created by the seventh example embodiment.

As shown in FIG. 14, the effect of the light-blocking elements 46 is to constrain the angular range of just the second set of light sources 42 (the red lights), so that green sparkling light is visible for observers facing and moving in all directions relative to the device (except the narrow ranges shown in FIG. 9 in which no light is visible), but red sparkling light is visible only within a central angular range. Here, both red and green sparkling lights are observed.

Figure 15:
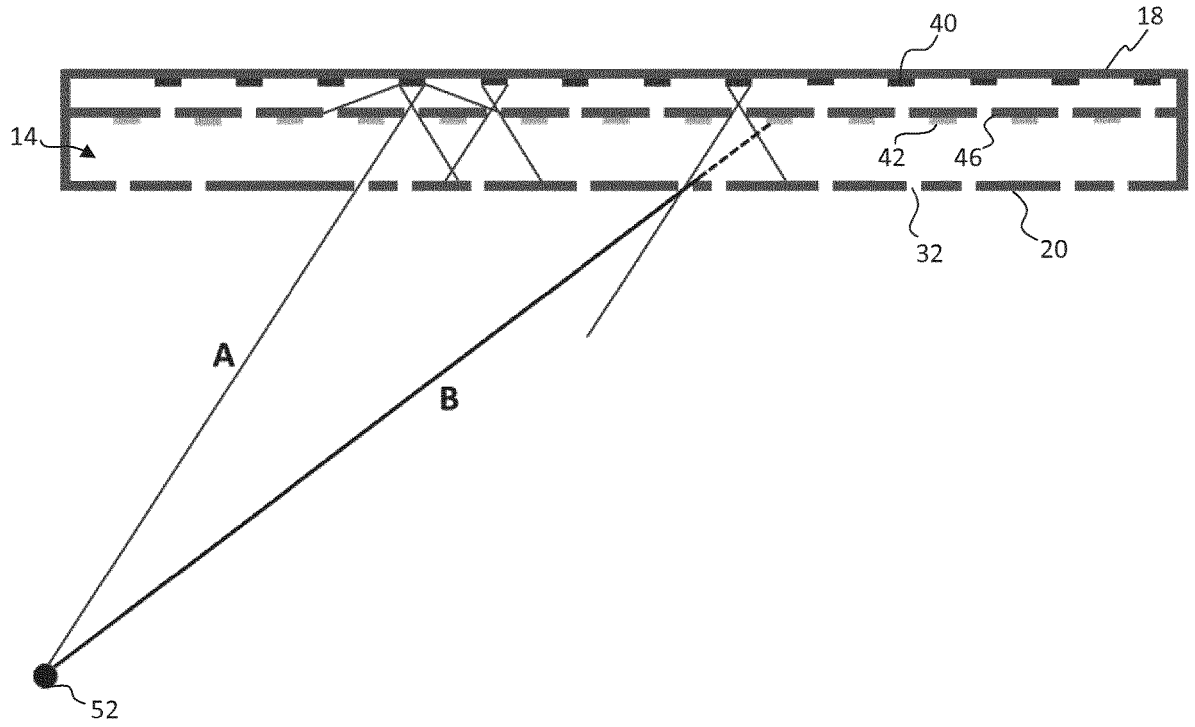
FIG. 15 schematically depicts an eighth example embodiment of the invention.

FIG. 15 shows a fourth example of this group of embodiments, again comprising two different sets of primary light sources, each set of primary light sources being configured to emit light corresponding to a different color of visible light. In this case a first set of primary light sources 40 are disposed at regular intervals along the internal surface of back panel 18, and are configured to emit light which is red. A second set of primary light sources 42 are disposed at horizontally interleaved positions, along a line (or plane) vertically displaced from the back panel, between the back panel 18 and the front panel 20. Each of the second set of primary light sources 42 is mounted to a surface of a respective light blocking element 46, formed of a horizontally linear wall element. The light blocking elements are horizontally aligned, with each pair of neighboring blocking elements defining a narrow space between them aligned vertically with each of the first set of primary light sources 40. These gaps define the angular constraints of the light emitted by the first set of primary light sources 40.

Figure 16:
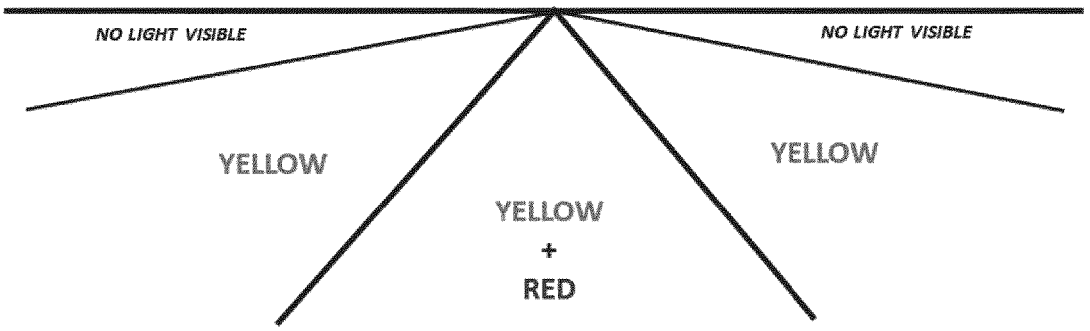
FIG. 16 schematically illustrates the optical effect created by the eighth example embodiment.

As shown in FIG. 16, the effect of this arrangement is to allow yellow sparkling light (emitted by the second set of primary light sources 42) to be seen by observers facing and moving at any angle and direction relative to the front panel 20 (except the narrow ranges shown in FIG. 16 in which no sparkling light is visible), but to constrain the visibility of red sparkling light (as emitted by the first set of primary light sources 40) to just a central angular range. In this central range, both yellow and red sparkling lights are observed. An example observer eye position 52 is shown in FIG. 15, and exemplary angular travel directions A and B illustrated by lines indicating the line of sight along such directions. Direction A lies within the central angular region, and here both red and yellow sparkling lights are observable. Direction B lies within the left-most angular region, and when facing and moving in this direction, as illustrated, light emitted by the red primary light sources 40 is not able to reach the observer's eye 52 along a direct path and so is not visible to such an observer as a source of sparkling.

Figure 17:
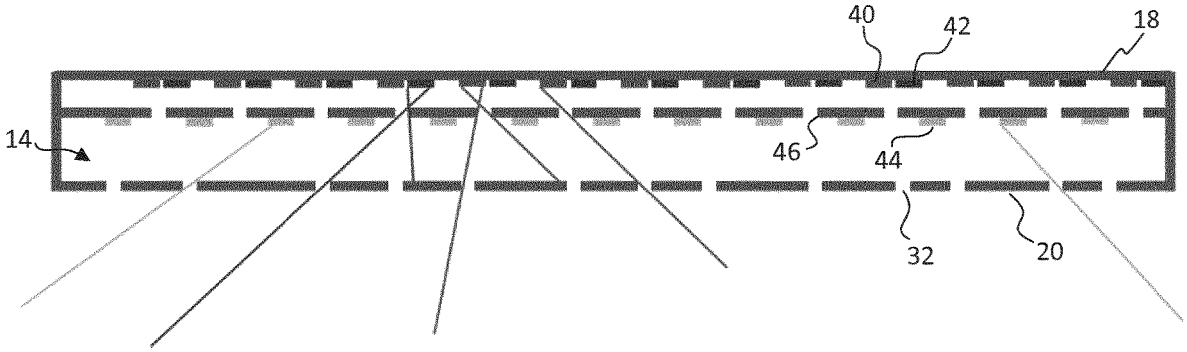
FIG. 17 schematically depicts a ninth example embodiment of the invention.

FIG. 17 shows a more complex example of this embodiment, comprising in this case three distinct sets of primary light sources, each adapted to emit light of a spectral composition corresponding to a different color, a first set of primary light sources 40, adapted to emit blue light, a second set of primary light sources 42 adapted to emit red light, and a third set of primary light sources 44 adapted to emit yellow light. As with the example of FIG. 15, the primary light sources are divided between two vertically displaced planes, with the third set of primary light sources 44 mounted to surfaces of light blocking elements 46 which are arranged in horizontal alignment, and together defining a plurality of regularly spaced openings formed by the gaps between neighboring elements. The first and second sets of primary light sources 40 and 42 are arranged in pair formation, as in the examples of FIGS. 9 and 11, with each pair formed of a blue-emitting primary light source 40 on the left and a red emitting primary light source 42 on the right. The gaps formed between neighboring light-blocking elements 46 are aligned horizontally with the center of each pair formation.

Figure 18:
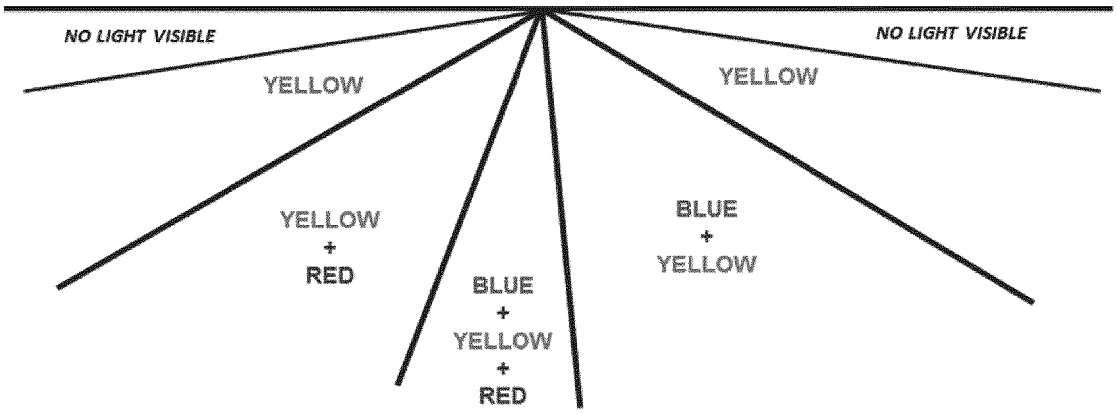
FIG. 18 schematically illustrates the optical effect created by the ninth example embodiment.

The effect of this arrangement is shown in FIG. 18, which illustrates the colors of sparkles visible when facing and travelling in different angular directions relative to the front panel. Yellow sparling light is visible over all angles (except the narrow ranges shown in which no sparkling light is visible). Red sparkles are visible only when facing and moving at least partially right-ward. Blue sparkling light is observable over a narrow range of right-ward angles only.

Figure 19:
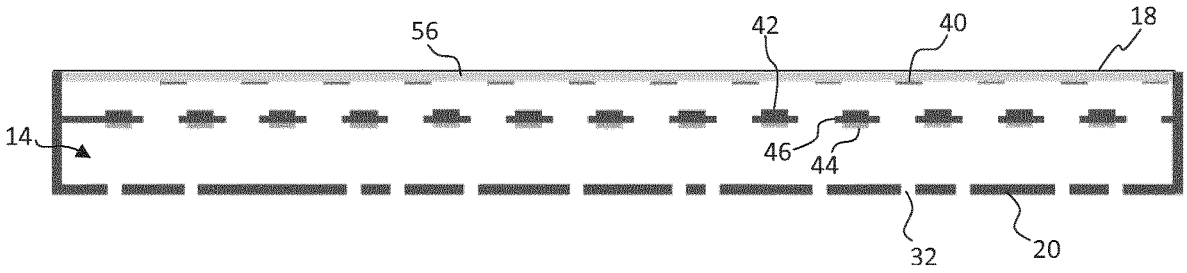
FIG. 19 schematically depicts a tenth example embodiment of the invention.

FIG. 19 shows a sixth example of an embodiment comprising primary light sources of multiple colors. As in the previous example, this example comprises three distinct sets of primary light sources 40, 42, 44. The first set of primary light sources 40 is adapted to emit green light, the second set of primary light sources 42 is adapted to emit yellow light and the third of primary light sources 44 is adapted to emit blue light (these of course, as in the previous examples, merely being exemplary).

In this case however, the third set of primary light sources 44 is mounted to the rear of the horizontally aligned light blocking elements 46, and light from these sources reaches the front of the panel by means of specular mirror arrangement 56 mounted across the inner surface of back panel 18. The specular mirror arrangement comprises a patterned surface which reflects light emitted by the third set of primary light sources 44 in correspondence with this pattern and redirects it toward the front panel 20 and the light exit areas 22 formed across it. Light emitted from the first set of primary light sources 40 is angularly constrained by the light blocking elements 46, and light emitted by the third set of primary light sources 44 is also similarly angularly constrained, as well as patterned by means of the pattern formed on the specular mirror arrangement 56.

Figure 20:
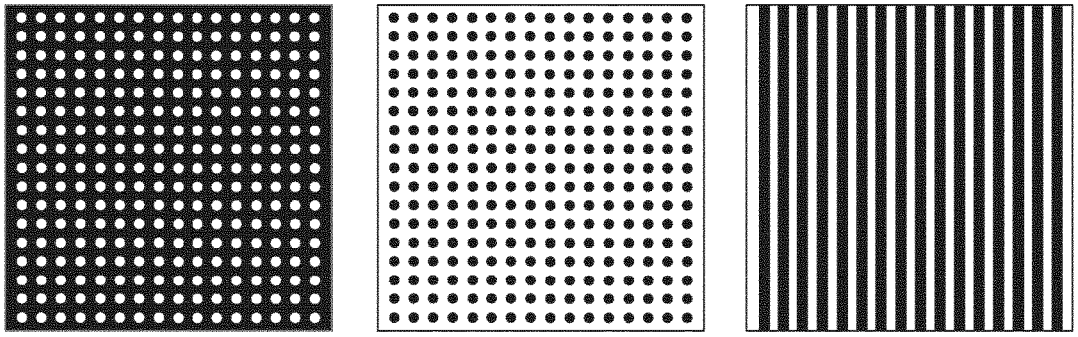
FIG. 20 illustrates example patterns for the mirror arrangement comprised by the tenth example embodiment.

Three examples of possible patterns for the specular mirror arrangement 56 are illustrated in FIG. 20. The patterns in these examples are formed by means of printing black paint onto the surface of a glass mirror. Other fabrication techniques however might alternatively be employed.

The arrangement of FIG. 19 produces a sparkling display configuration of many different color-angle combinations, and the particular angular distributions may depend upon the pattern of the mirror arrangement 56, the width of the gaps between neighboring light blocking elements 46 and the vertical separation between the third set of primary light sources 44 and the mirror arrangement 56.

According to any of this group of embodiments, the light blocking elements 46 may be fabricated by means of 3D printing onto a PCB (for example a MCPCB) to which the light sources are mounted. The light blocking elements may in examples be completely absorbing, or may alternatively be partly or fully reflective (for example specularly reflective). The light blocking elements could themselves be different colors in different examples, for example black where absorption is desired, or white where more reflection is desired.

Figure 21:
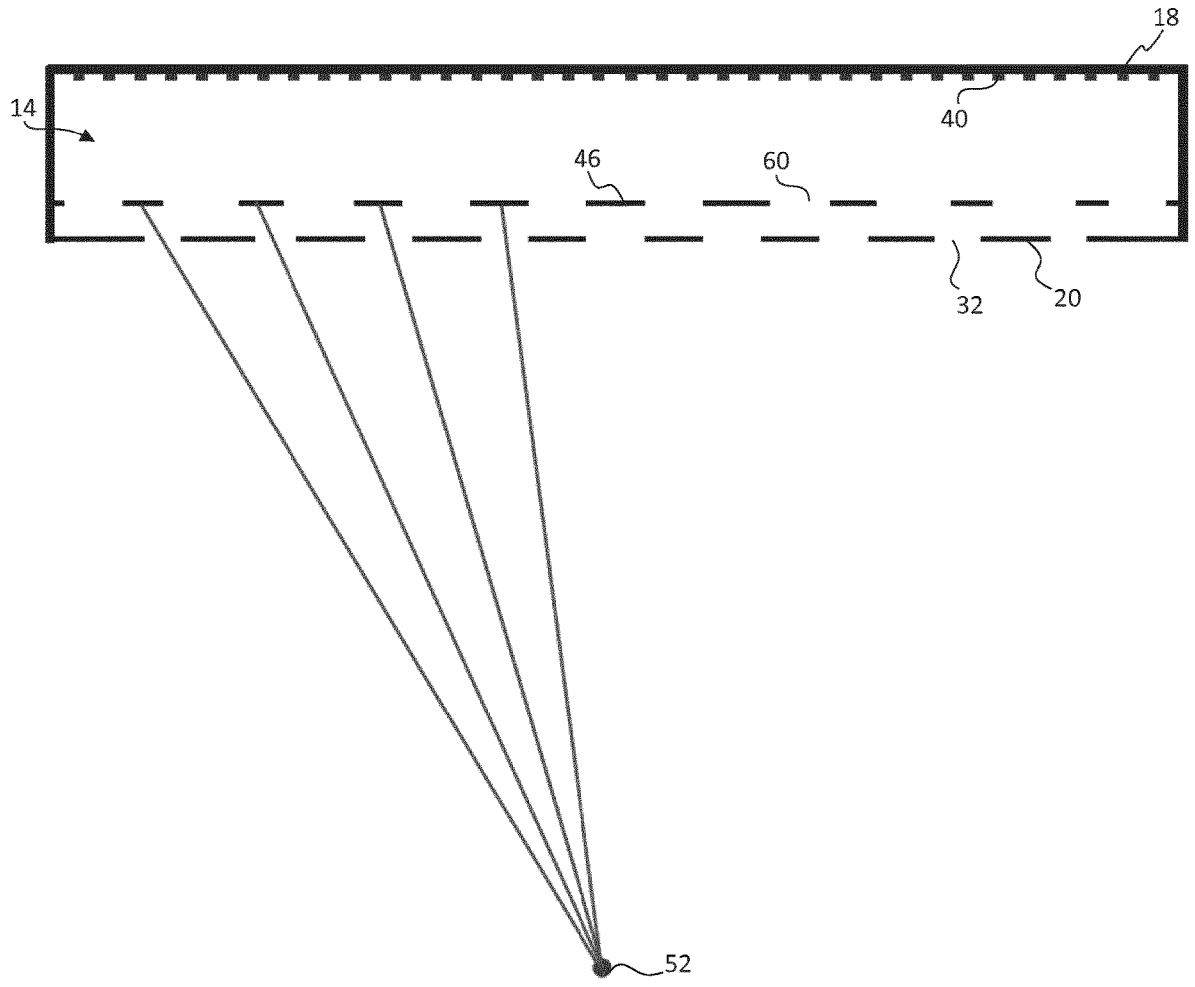
FIG. 21 schematically depicts an eleventh example embodiment of the invention.

In FIG. 21 is shown a different embodiment of the invention, comprising a single set of primary light sources 40 disposed along an inner surface of back panel 19. The device further comprises a set of horizontal linear light blocking elements 46, arranged in horizontal alignment with the light exit areas 32. As illustrated, these have the effect of forming a single discrete 'blind spot' at which direct view of all light sources become obscured, regardless of the angular direction of travel of the observer. By adding additional layers of light blocking elements, multiple such blind spots may be created.

According to examples of any embodiment of the invention, additional optical elements may be provided to shape or redirect light emitted by one or more of the primary light sources. For example, these elements may include a lens such as a converging lens or a Fresnel lens (to achieve a degree of collimation of the emitted light), or may include a prism adapted for instance to split or redirect emitted beams of light.

These elements may additionally or alternatively comprise one or more color filters or films, for enabling transmission of light of only a particular set or range of frequencies or wavelengths. These filters or films may in examples be provided comprised by, or positioned in optical alignment or correspondence with, one or more of the light exit areas. Alternatively, said filters or films may be positioned in alternative locations within the chamber, for example disposed atop light emitting surfaces of one or more of the primary light sources, or arranged in optical alignment with optical axes of one or more of the primary light sources.

Additionally or alternatively, the translucent front panel 20 may comprise or partially consist of one or more color filter elements such that the functional background light exiting the chamber may be altered to adopt a particular desired color. In particular, one or more portions of the translucent front panel may be colored or the translucent front panel may comprise one or more auxiliary color filters coupled to the translucent panel for coloring outgoing light.

Figure 22:
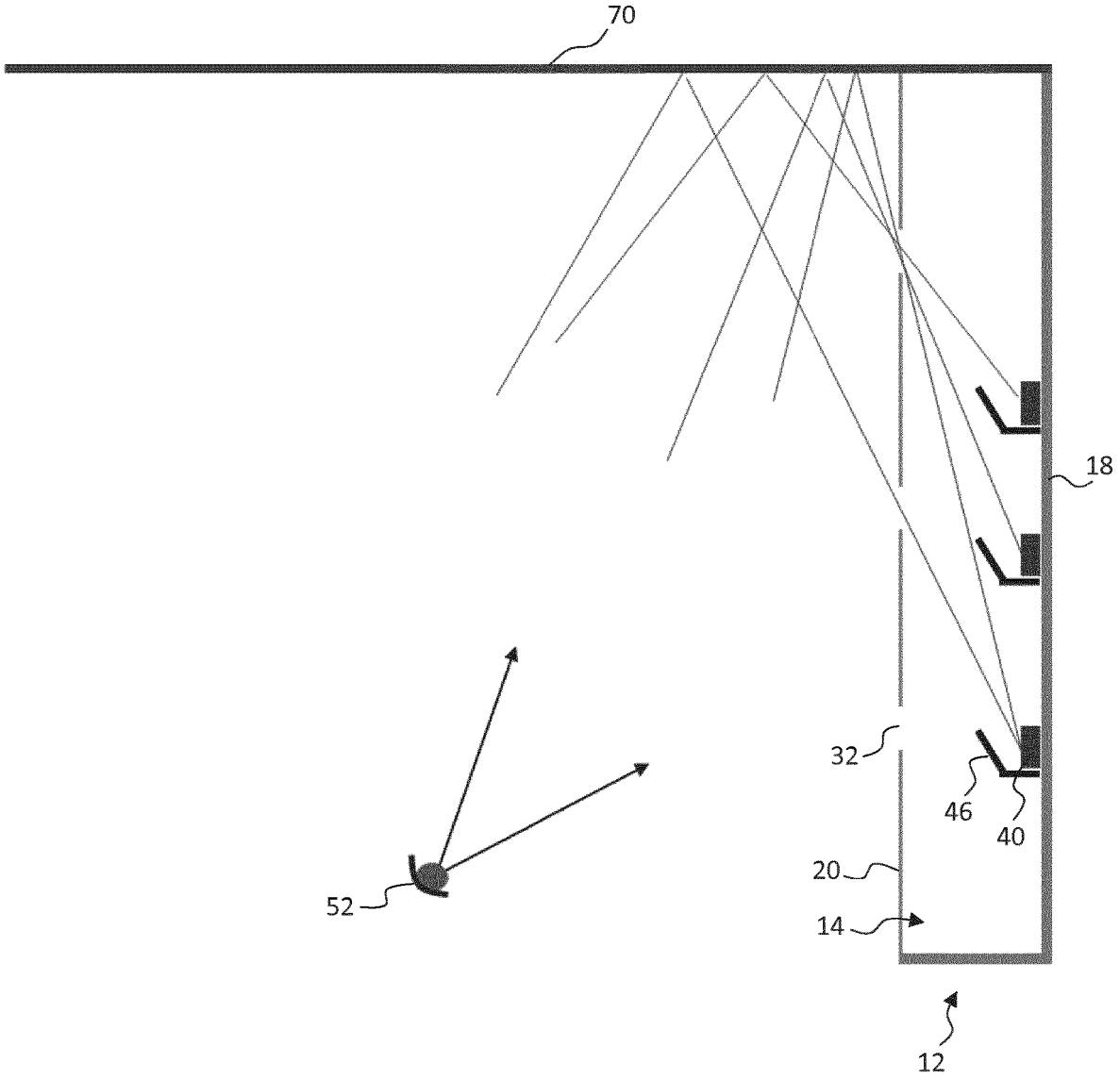
FIG. 22 schematically depicts an example lighting assembly in accordance with an aspect of the invention.

According to a further example embodiment, illustrated in FIG. 22, there is provided an assembly comprising a lighting device 12 in accordance with embodiments of the invention, being a lighting panel or lighting box, and a mirror 70 arranged at an angle (in this case perpendicularly or substantially perpendicularly) with respect the front panel of the lighting device 12. The lighting device 12 comprises light blocking elements 46 configured so as to deflect light emitted by the primary light sources 40 in a tangential direction through the light exit areas 32 and toward the surface of the mirror 70 from which it is reflected. In consequence of the shape of light blocking elements, an observer situated in a position 52 does not see any sparkles emanating from the device when looking directly at the translucent front panel 20, but does see the sparkling effect when looking in the direction of the mirror. The assembly of FIG. 22 effectively provides a means of reorienting the sparkling effect to render it visible when not looking directly at the panel. This can produce a visually striking effect, since the source of the sparkling light display is not immediately apparent; the device itself does not appear to be generating any sparkle effect (to an observer looking from position 52).

According to one or more example embodiments, one or more internal surfaces of the chamber may be configured to reflect light only of certain spectral frequencies or compositions. For example, said surfaces may be configured to be colored or tinted so as to thereby only reflect light of particular colors or only to reflect particular color components of incident light. This provides further flexibility in manipulating the colors of outgoing light—both functional and sparkling light.

In most of the above described embodiments, examples have been described in detail for lighting devices comprising box or panel-shaped devices. These comprise a frame structure consisting of a back panel 18, a front panel 20 and four side panels 22, 24. Such a construction is simple and cheap to manufacture. It also allows the device to be very lightweight. The architecture allows for easy assembly. Furthermore, in examples, light exit areas may be cut into a front panel quickly and easily by automated digital manufacturing techniques such as laser cutting or stamping, allowing speed, low-cost and customizability.

However, it is to be understood that the inventive concept is not limited to such box or panel shaped constructions. In alternative examples, the device may comprise a frame bounding an internal chamber having any desired outer shape, for example cylindrical, spherical, ellipsoidal, pyramidal, cone-shaped, or any non-regular variation on one or more of these or other shapes.

In one example, for instance, a tubular construction may be provided, wherein the primary light sources are disposed on a dedicated mounting surface portion provided in the middle of the chamber, such that the primary light sources are arranged to direct light outward in directions toward translucent cylindrical walls of the chamber, the inner surfaces of which form the translucent surface portion through which the light exit areas are formed.

In particular examples, there may be provided lighting strips running through the chamber, each comprising a plurality of primary light sources arranged linearly along the strip and configured to each emit in one or more azimuthal directions (or otherwise toward the cylindrical inner surfaces of the chamber). The lighting strips may be curved or bent or warped such that the distance between primary light sources and the light exit areas varies. This adds extra dynamism to the resulting sparkling light display, by effecting a variation in the size of the visible zones created by each of the light exit areas, and so changing the rate at which different exit areas appear or disappear from view.

In another example, a substantially spherical device may be provided (as in the example of FIG. 8), wherein the primary light sources are again mounted to a dedicated mounting surface portion provided at a central or middle region of the defined spherical chamber, and arranged to direct light outward toward the spherical boundary of the chamber, through which the light exit areas are formed.

Application of the invention is not limited to embodiments comprising regular shaped constructions, such as spherical, cylindrical or cubic shaped outer shells or frames. Rather, the invention may be applied broadly to embodiments comprising inner chambers bound by translucent outer frames or structures of any shape, either regular or irregular. For example, in particular embodiments, the device might comprise an inner chamber bound by an outer surface or shell structure shaped to form a custom 3D shape. The custom 3D shape might for example be modelled on a particular 3D object or 3D object design. Light exit areas may be provided at various points through the surface of said outer 3D shape, either in accordance with a regular pattern, or an irregular arrangement.

In examples, the locations of (at least some of) the light exit areas might for instance be chosen to coincide with particular features or areas of the custom 3D shape, either (say) to highlight said features, or for instance to avoid highlighting certain other features or portions of the shape.

Primary light sources may in accordance with these embodiments be disposed within the chamber mounted to a mounting surface which itself follows a non-regular shape or contour(s). The mounting surface might for instance be provided having a shape or construction in three dimensions which follows the shape or contours of the outer shell structure itself. Alternatively, the mounting surface may follow a different shape or configuration in three dimensions.

In either case, the primary light sources may be arranged within the chamber so as to direct light at multiple angles toward the inner surface of the outer shell. This may be, in examples, so as to provide light along a plurality of optical axes, each aligned substantially normal with the inner surface of the outer shell. Alternatively, it may be so as to provide light along optical axes forming different angles with the inner surface of the outer shell. This might for example provide a more dynamic, varied or surprising aesthetic effect to observers looking at the outside of the device.

In accordance with at least some embodiments of the invention, particular dimensional constraints or ratios may be preferred for aesthetic, structural or functional reasons. In particular, the following descriptions are intended to be most applicable for embodiments of the lighting device comprising a panel or box-shaped construction, as in the above described embodiments, and also in the majority of the embodiments to be described below.

For interior design purposes, the overall width of the panel may be in the order a single meter, and the light emitting components may be individual LEDs, having typical dimensions of approximately 1 mm.

For interior design applications, the 'vertical' separation distance between the front 20 and back 18 panels may, for a "thin" panel, not exceed approximately 50 mm, and in addition, for practicality reasons, may typically not be less that 1 mm. For an aesthetically appealing effect, in which light sources 28 do not appear overly 'crowded', the size of the primary light source may be smaller than the separation distance between any two neighboring primary light sources. However, to ensure that the display does not appear too sparse, and to achieve a noticeable effect, the separation distance between any two neighboring primary light sources may be kept to within 20 times the size or width or diameter of each primary light source.

Also to maximize the aesthetic appeal, so that the display does not appear too sparse, but at the same time to achieve a noticeable effect, the light exit areas 32 may be formed having a separation distance which does not exceed 20 times the width or diameter of said light exit areas.

In order that an observer is not able to see two primary light sources 28 through the same light exit area 32, the width or diameter of each light exit area may be smaller than the separation distance between neighboring primary light sources. However, in order to ensure a visible and optically efficient (i.e. little wasted light) glittering effect, each light exit area may be formed with a size not substantially smaller than the width or diameter of the primary light sources.

Variations within the above parameters may influence the resultant sparkling effect. For example, the shorter the separation distance between the front panel 20 and the back panel 18, the slower the 'on/off' transitions between visibility of a given sparkle and apparent vanishing of said sparkle. In addition, larger light exit areas 32 render the sparkling more obvious and plainly visible, while smaller exit areas render it more subtle and elegant.

For outdoor architectures, the device may be constructed with larger overall outer dimension (for example several meters), and the primary light sources 28 may comprise clusters or assemblies of LEDs instead of individual LEDs. The geometry described above in connection with indoor architectures is scalable and adjustable for the size of the overall panel, the distance of the viewer to the panel and the speed of the viewer (walking-by viewer or cycling-by viewer). Critical parameters and LED size are also scalable in the same way, so that LEDs for example may, according to the particular application, have (by way of example only) dimensions of 1×1 mm, 4×4 mm or 10×10 mm (e.g. chip-on-board (COB) LEDs).

Diameters of light exit areas may also vary for different applications, as well as the front-back panel separation distance. According to particular examples, front-back panel separation distance may (by way of non-limiting example only) have values for instance of 10 mm, 50 mm or 200 mm. However, as will be appreciated by the skilled person, the example dimensions given with respect to front-back panel separation distance, as well as for LED size, are given by way of example only, and other particular dimensions may equally be used in any embodiment of the invention.

In the aforementioned examples, the primary light sources that are located on the first surface portion are typically "real" light sources, such as light sources comprising one or more LEDs, and the first surface portion is a mounting surface portion on which the primary light sources are mounted. Alternatively, the primary light sources that are located on the first surface portion may be "virtual" light sources.

In at least some embodiments, the one or more primary light sources are virtual primary light sources and the lighting device comprises features adapted to provide or generate these one or more virtual primary light sources within the chamber. According to these examples, additional optical components may be provided to generate virtual primary lighting sources having apparent extended light-emitting surface areas and/or unconventional or non-standard (e.g. free-form) shapes of light emitting area.

Such virtual light sources may be located on a light outcoupling (or light extraction) surface of a waveguide (or light guide). Compared to the examples with "real" primary light sources mounted on a mounting surface portion, this construction represents a more flexible lighting device as it more easily allows an increase in sparkle density and/or change of the sparkle shape.

In accordance with one set of examples for instance, the lighting device may further comprise one or more waveguides, said waveguides configured to receive light from one or more light sources such as LEDs. For instance, one or more waveguides may be provided having LEDs (for instance LED strips) provided coupled to one or more internal surfaces or boundaries of the waveguide, e.g. the side-walls.

In particular examples, the back surface or boundary of the waveguide may be provided with (for example painted) dots, lines curves or other graphic or geometric patterns. These might for example be applied with full color inkjet printing. These may in examples comprise white (e.g. paint) or phosphor (to 'convert' blue LED light to white or other colors of light) patterns, such that virtual light spots, lines or patterns are created. Adjacent (for example some distance behind) the wave-guide, a light-absorptive (e.g. black) layer or sheet may be provided to absorb any stray light.

The waveguide may be an edge-lit light guide panel having lower and upper opposing major surfaces separated by at least one edge surface, wherein a plurality of LEDs is located adjacent to the edge surface, the plurality of LEDs being arranged to emit light into the light guide panel via the edge surface, and wherein the upper major surface of the light guide panel is a light outcoupling surface.

In a first example of a lighting device according to the invention, wherein the primary light sources that are located on the first surface portion are virtual light sources on a light outcoupling surface of a light guide, the light outcoupling surface of the light guide panel comprises light outcoupling structures to couple light out of the light guide panel. The lighting device further comprises a perforated layer adjacent to the light outcoupling surface of the light guide panel. The perforated layer has a back side facing towards the light outcoupling surface of the light guide panel and an upper side facing away from the light outcoupling surface of the light guide panel. The combination of the light guide panel and the perforated layer is arranged to create a plurality of primary light sources on a first surface portion, wherein the primary light sources are virtual light sources, and wherein the first surface portion is the upper surface of the perforated layer.

The color of the secondary light sources in the upper surface of the perforated layer can be changed by providing a luminescent material in the light outcoupling structures on the light outcoupling surface of the light guide panel. Light outcoupling structures that comprise a luminescent material may also be used to obtain a "color-over-angle" sparkling effect, i.e. a sparkling effect wherein the color varies as a function of the angle of emitted light.

The perforated layer may be a plastic layer or a cardboard layer. The perforated layer may have a white back side facing towards the light outcoupling surface of the light guide panel and a black upper side facing away from the light outcoupling surface of the light guide panel.

In a second example of a lighting device according to the invention, wherein the primary light sources that are located on the first surface portion are virtual light sources on a light outcoupling surface of a light guide, the lower major surface of the light guide panel (i.e. the major surface opposite the light outcoupling surface) comprises a plurality of light outcoupling structures, wherein each of these light outcoupling structures has a specularly reflective surface for reflecting light that is travelling within the light guide in a direction towards the light outcoupling surface of the light guide.

Instead of primary light sources in the form of virtual light sources that are located on a light outcoupling surface of a light guide, virtual primary light sources may also be formed in a different way. For example, real light sources may be provided at an inner surface of the second surface portion, wherein these real light sources are arranged to emit light towards the first surface portion, and wherein the first surface portion has a specularly reflective inner surface, such as a multi-directional specularly reflective inner surface. The plurality of primary light sources located on the first surface portion is then a plurality of virtual primary light sources formed by specular reflections of light emitted by real light sources located on the inner surface of the second surface portion.

In accordance with these or any other embodiments, the translucent front panel may comprise dot (e.g. square, circular, triangular) light exit areas, or may alternatively or additionally comprise linearly extended (straight or curved line) light exit areas. This may provide an additional or alternative light effect.

In one particular example for instance, a diagonal line-shaped virtual primary light source might be provided at the back panel, and a diagonal line-shaped light exit area provided to the front of the panel, in optical communication with the diagonal line-shaped virtual primary light source, and formed at an angle (of e.g. 90 degrees) to the primary light source. The effect for an observer moving, for instance, from left to right across the front of the lighting device, is the observation of a sparkle light source which appears to move or glide from a lower region on the panel to a higher region on the panel as they walk (or vice versa).

These examples may be used in accordance with (or in combination with) any described embodiment, by making simple substitution of one or more 'real' (point) primary light sources with the above described extended or free-form 'virtual' primary light sources. Such virtual primary light sources might also be combined with real primary light sources.

As noted briefly above, in accordance with any embodiment, the transparency of the translucent surface portion 20 be made wavelength dependent (i.e. may provide color-filtering effect). This can, by way of non-limiting example only, be done by 'gluing' or otherwise affixing of coupling a (e.g. red) color-filter (e.g. foil) to the translucent front panel and then (e.g. laser) drilling holes to form light exit areas 32.

The thus formed diffuser/color-filter stack can be integrated with the main housing delimiting the chamber 14 in at least the following two example ways. Firstly, the filter may be affixed to the outside surface of the chamber, so that, only white Lambertian background light exits through the light exit areas. Or, secondly, the filter may be affixed to the inside surface of the chamber 14, so that only red Lambertian background light exits through the light exit areas.

Another example possibility is to use a single front panel element comprised of two bulk material properties, one providing color-filter functionality, the other providing diffusion functionality for example.

In another example, the first surface portion is translucent and/or comprises a first plurality of light-transmissive areas, while the plurality of light exit areas delimited by the translucent second surface portion represents a second plurality of light-transmissive areas, wherein at least part of the inner surface of the translucent second surface portion facing towards the first surface portion is at least partly (specularly) reflective. In this example, a sparkling effect is provided at a front side of the lighting device and, dependent on the type of reflective inner surface and the translucency of the first surface portion, indirect (diffuse) illumination via a back side of the lighting device or also a sparkling effect.

The first and second surface portions may both have a plurality of light-transmissive areas (such as a plurality of holes) and a reflective inner surface. To provide a sparkling effect at both sides of the lighting device, the reflective inner surfaces must be specularly reflective.

In all of the aforementioned examples, the second surface portion may be comprised in a textile or fabric layer, or in a foil. This will result in a lighting device of reduced weight.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting device for simultaneously providing functional lighting for illuminating a space and for providing to an observer of the lighting device a spatially dynamic sparkling or glittering effect of the lighting device, wherein the lighting device comprises an exposed outer surface and a plurality of primary light sources disposed within a chamber, wherein the chamber has an internal surface arrangement including at least a first surface portion and an opposing second surface portion, the first surface portion being a mounting surface portion, each of the plurality of primary light sources comprising an LED that is mounted to the mounting surface portion, the second surface portion being translucent and delimiting a plurality of light exit areas having a higher transmittance than the second surface portion, wherein the plurality of light exit areas comprises a first pattern of light exit areas, the plurality of primary light sources comprises a second pattern of primary light sources, the second pattern of primary light sources being different to the first pattern of light exit areas, wherein the plurality of primary light sources is arranged to illuminate the plurality of light exit areas delimited by the translucent second surface portion in order to create a plurality of secondary light sources located on the exposed outer surface of the lighting device, each of the plurality of secondary light sources producing an anisotropic luminance effect on the exposed outer surface of the lighting device when the lighting device is viewed by the observer; and wherein one or more internal surfaces of the chamber are at least partially reflective and optionally wherein said internal surfaces are bounding internal surfaces.

2. A lighting device as claimed in claim 1, wherein each of the LEDs and each of the light exit areas has a size that is smaller than a separation distance between any two neighboring LEDs, and wherein at least one of the first pattern of light exit areas and the second pattern of primary light sources is an irregular or semi-random pattern.

3. A lighting device as claimed in claim 1, further comprising one or more optical elements each arranged in optical communication with one or more of the plurality of light exit areas, wherein each optical element is adapted to absorb, deflect or refract a portion of the light incident at them.

4. A lighting device as claimed in claim 3, wherein each optical element is directly coupled to or is comprised by one or more of the plurality of light exit areas.

5. A lighting device for simultaneously providing functional lighting for illuminating a space and for providing to an observer of the lighting device a spatially dynamic sparkling or glittering effect of the lighting device, wherein the lighting device comprises an exposed outer surface and a plurality of primary light sources disposed within a chamber, wherein the chamber has an internal surface arrangement including at least a first surface portion and an opposing second surface portion, the first surface portion being a mounting surface portion, each of the plurality of primary light sources comprising an LED that is mounted to the mounting surface portion, the second surface portion being translucent and delimiting a plurality of light exit areas having a higher transmittance than the second surface portion, wherein the plurality of light exit areas comprises a first pattern of light exit areas, the plurality of primary light sources comprises a second pattern of primary light sources, the second pattern of primary light sources being different to the first pattern of light exit areas, wherein the plurality of primary light sources is arranged to illuminate the plurality of light exit areas delimited by the translucent second surface portion in order to create a plurality of secondary light sources located on the exposed outer surface of the lighting device, each of the plurality of secondary light sources producing an anisotropic luminance effect on the exposed outer surface of the lighting device when the lighting device is viewed by the observer;

wherein the plurality of primary light sources comprises at least a first subset of primary light sources and a second subset of primary light sources, the first subset of primary light sources being configured to emit light that is directly incident at one or more of the plurality of light exit areas, and the second subset of primary light sources being configured to emit light that is not directly incident at any of the plurality of light exit areas; and wherein the output intensity of each of the first and second subsets of primary light sources is independently adjustable.

6. A lighting device as claimed in claim 5, wherein the lighting device further comprises a controller configured to adjust the output intensity of the first subset of primary light sources in dependence upon the output intensity of the second subset of primary light sources.

7. A lighting device as claimed in claim 1, wherein the lighting device further comprises a translucent front panel positioned directly opposing an exterior side of said translucent second surface portion, and a space in between the translucent front panel and the translucent second surface portion.

8. A lighting device as claimed in claim 7, wherein the space in between the translucent front panel and the translucent second surface portion is configured to receive and/or at least partially retain a light transmissive fluid.

9. A lighting device for simultaneously providing functional lighting for illuminating a space and for providing to an observer of the lighting device a spatially dynamic sparkling or glittering effect of the lighting device, wherein the lighting device comprises an exposed outer surface and a plurality of primary light sources disposed within a chamber, wherein the chamber has an internal surface arrangement including at least a first surface portion and an opposing second surface portion, the first surface portion being a mounting surface portion, each of the plurality of primary light sources comprising an LED that is mounted to the mounting surface portion, the second surface portion being translucent and delimiting a plurality of light exit areas having a higher transmittance than the second surface portion, wherein the plurality of light exit areas comprises a first pattern of light exit areas, the plurality of primary light sources comprises a second pattern of primary light sources, the second pattern of primary light sources being different to the first pattern of light exit areas, wherein the plurality of primary light sources is arranged to illuminate the plurality of light exit areas delimited by the translucent second surface portion in order to create a plurality of secondary light sources located on the exposed outer surface of the lighting device, each of the plurality of secondary light sources producing an anisotropic luminance effect on the exposed outer surface of the lighting device when the lighting device is viewed by the observer; and wherein the plurality of primary light sources comprises a first set of primary light sources adapted to emit light of a first spectral composition, and a second set of primary light sources adapted to emit light of a second spectral composition, wherein the chamber is arranged to at least partially mix the light of the first spectral composition with that of the second spectral composition.

10. A lighting device as claimed in claim 9, further comprising one or more further optical elements together adapted to direct light emitted by the first set of primary light sources through the light exit areas at a first range of propagation angles, and to direct light emitted by the second set of primary light sources through the light exit areas at a second range of propagation angles, and wherein optionally the further optical elements comprise light blocking elements adapted to deflect or absorb at least a portion of the light emitted by the first and/or second sets of primary light sources.

11. A lighting device for simultaneously providing functional lighting for illuminating a space and for providing to an observer of the lighting device a spatially dynamic sparkling or glittering effect of the lighting device, wherein the lighting device comprises an exposed outer surface and a plurality of primary light sources disposed within a chamber, wherein the chamber has an internal surface arrangement including at least a first surface portion and an opposing second surface portion, the first surface portion being a mounting surface portion, each of the plurality of primary light sources comprising an LED that is mounted to the mounting surface portion, the second surface portion being translucent and delimiting a plurality of light exit areas having a higher transmittance than the second surface portion, wherein the plurality of light exit areas comprises a first pattern of light exit areas, the plurality of primary light sources comprises a second pattern of primary light sources, the second pattern of primary light sources being different to the first pattern of light exit areas, wherein the plurality of primary light sources is arranged to illuminate the plurality of light exit areas delimited by the translucent second surface portion in order to create a plurality of secondary light sources located on the exposed outer surface of the lighting device, each of the plurality of secondary light sources producing an anisotropic luminance effect on the exposed outer surface of the lighting device when the lighting device is viewed by the observer;

wherein the translucent second surface portion comprises one or more shaped opaque regions for patterning the light output from the lighting device and/or wherein the lighting device comprises a front panel element comprising one or more shaped opaque regions for patterning light output from the lighting device.

12. A lighting device as claimed in claim 1 wherein in use, the plurality of secondary light sources provides the exposed outer surface with a dynamic sparkling effect.

13. A lighting device as claimed in claim 1, wherein each of the primary light sources has an optical axis;

wherein the light exit areas are provided by holes in the second surface portion; and, wherein said holes are formed at angles that are non-parallel with the optical axes of the primary light sources.

* * * * *